US010641451B2

(12) United States Patent
Kawai et al.

(10) Patent No.: US 10,641,451 B2
(45) Date of Patent: May 5, 2020

(54) VEHICLE LAMP AND SUBSTRATE

(71) Applicant: KOITO MANUFACTURING CO., LTD., Tokyo (JP)

(72) Inventors: Hiroki Kawai, Shizuoka (JP); Takahiko Honda, Shizuoka (JP); Shinji Kagiyama, Shizuoka (JP); Naoki Uchida, Shizuoka (JP); Ryuho Sato, Shizuoka (JP); Akinori Matsumoto, Shizuoka (JP); Hiroyuki Ishida, Shizuoka (JP); Takashi Inoue, Shizuoka (JP)

(73) Assignee: KOITO MANUFACTURING CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/062,455

(22) PCT Filed: Dec. 13, 2016

(86) PCT No.: PCT/JP2016/087124

§ 371 (c)(1),
(2) Date: Jun. 14, 2018

(87) PCT Pub. No.: WO2017/104678

PCT Pub. Date: Jun. 22, 2017

(65) Prior Publication Data

US 2018/0363874 A1 Dec. 20, 2018

(30) Foreign Application Priority Data

Dec. 15, 2015 (JP) ..... 2015-244410
Dec. 15, 2015 (JP) ..... 2015-244411
(Continued)

(51) Int. Cl.
*F21S 41/275* (2018.01)
*F21S 45/47* (2018.01)
(Continued)

(52) U.S. Cl.
CPC ..... *F21S 41/275* (2018.01); *F21S 41/147* (2018.01); *F21S 41/148* (2018.01); *F21S 41/151* (2018.01);
(Continued)

(58) Field of Classification Search
CPC ..... F21S 41/275; F21S 45/43; F21S 41/37; F21S 41/36; F21S 41/147; F21S 41/00; F21S 41/663
See application file for complete search history.

(56) References Cited

U.S. PATENT DOCUMENTS 5,068,768 A * 11/1991 Kobayashi ..... F21S 41/28 362/539
5,746,491 A * 5/1998 Tatsukawa ..... F21S 41/28 362/507
(Continued)

FOREIGN PATENT DOCUMENTS

CN 204404003 U 6/2015
DE 10-2010-015243 A1 10/2011
(Continued)

OTHER PUBLICATIONS

Search Report dated Mar. 7, 2017, issued by the International Searching Authority in International Application No. PCT/JP2016/087124 (PCT/ISA/210).
(Continued)

*Primary Examiner* — Donald L Raleigh
(74) *Attorney, Agent, or Firm* — Sughrue Mion, PLLC

(57) ABSTRACT

A vehicle lamp configured to selectively perform a low-beam irradiation and a high-beam irradiation includes a projector lens, a light emitting element disposed behind the projector lens and configured to emit light for forming a low-beam light distribution pattern, a light emitting element disposed behind the projector lens and configured to emit
(Continued)

light for forming an additional high-beam light distribution pattern, a upward reflecting surface (shade) disposed behind the projector lens and configured to form a cutoff line of the low-beam light distribution pattern, and an optical path change portion configured to change an optical path of a part of light emitted from the light emitting element so as to travel toward a portion between the low-beam light distribution pattern and the additional high-beam light distribution pattern.

11 Claims, 20 Drawing Sheets

(30) Foreign Application Priority Data

Dec. 15, 2015 (JP) ..... 2015-244412
Dec. 15, 2015 (JP) ..... 2015-244413

(51) Int. Cl.

| | |
|---|---|
| ***F21S 41/32*** | (2018.01) |
| ***F21S 41/151*** | (2018.01) |
| ***F21S 41/148*** | (2018.01) |
| ***F21S 41/19*** | (2018.01) |
| ***F21S 41/20*** | (2018.01) |
| ***F21S 41/365*** | (2018.01) |
| ***F21S 41/663*** | (2018.01) |
| ***F21S 41/147*** | (2018.01) |
| ***F21S 41/36*** | (2018.01) |
| ***F21S 41/37*** | (2018.01) |
| *F21W 102/13* | (2018.01) |
| *F21W 102/145* | (2018.01) |
| *F21S 45/43* | (2018.01) |

(52) U.S. Cl.

CPC ..... *F21S 41/19* (2018.01); *F21S 41/285* (2018.01); *F21S 41/321* (2018.01); *F21S 41/36* (2018.01); *F21S 41/365* (2018.01); *F21S 41/37* (2018.01); *F21S 41/663* (2018.01); *F21S 45/47* (2018.01); *F21S 45/43* (2018.01); *F21W 2102/13* (2018.01); *F21W 2102/145* (2018.01)

(56) References Cited

U.S. PATENT DOCUMENTS

| | | | | |
|---|---|---|---|---|
| 6,224,246 | B1 * | 5/2001 | Natsume | F21S 43/30 362/518 |
| 6,343,869 | B1 * | 2/2002 | Kobayashi | B60Q 1/085 362/37 |
| 2005/0180139 | A1 * | 8/2005 | Takeda | B60Q 1/12 362/276 |
| 2006/0120094 | A1 | 6/2006 | Tsukamoto et al. | |
| 2007/0201241 | A1 | 8/2007 | Komatsu | |
| 2009/0103323 | A1 * | 4/2009 | Ishida | F21S 41/147 362/538 |
| 2009/0257240 | A1 * | 10/2009 | Koike | F21S 41/275 362/538 |
| 2011/0205748 | A1 | 8/2011 | Yatsuda | |
| 2012/0134164 | A1 * | 5/2012 | Park | B60Q 1/143 362/464 |
| 2012/0262935 | A1 | 10/2012 | Yamamoto | |
| 2013/0188375 | A1 | 7/2013 | Masuda et al. | |
| 2014/0016342 | A1 * | 1/2014 | Rice | F21S 41/143 362/517 |
| 2015/0103551 | A1 | 4/2015 | Tanaka | |
| 2015/0308647 | A1 | 10/2015 | Lee | |

FOREIGN PATENT DOCUMENTS

| | | | | | |
|---|---|---|---|---|---|
| EP | 2937625 | A1 | | 10/2015 | |
| JP | 2006-164735 | A | | 6/2006 | |
| JP | 2013-152873 | A | | 8/2013 | |
| JP | 2014-63604 | A | | 4/2014 | |
| JP | 2014-120342 | A | | 6/2014 | |
| JP | 2014107048 | A | * | 6/2014 | F21S 41/285 |
| JP | 2014120342 | A | * | 6/2014 | F21S 41/147 |
| JP | 2015-76375 | A | | 4/2015 | |
| WO | 2012005684 | A1 | | 1/2012 | |

OTHER PUBLICATIONS

Written Opinion dated Mar. 7, 2017, issued by the International Searching Authority in International Application No. PCT/JP2016/087124 (PCT/ISA/237).

Communication dated Jul. 22, 2019, from the European Patent Office in counterpart European Application No. 16875655.9.

Communication dated Jan. 21, 2020, from the State Intellectual Property Office of People's Republic of China in counterpart Application No. 201680073187.5.

* cited by examiner

VEHICLE LAMP AND SUBSTRATE

TECHNICAL FIELD

The disclosure relates to a vehicle lamp and a substrate used for the vehicle lamp.

BACKGROUND ART

Conventionally, in order to reduce a size, a vehicle lamp includes a light source unit configured to individually turn on a plurality of light emitting elements and has a projector type optical system using a single projector lens, and is capable of selectively performing a low-beam irradiation and a high-beam irradiation (see Patent Document 1).

PRIOR ART DOCUMENT

Patent Document

Patent Document 1: JP-A-2006-164735

SUMMARY OF THE INVENTION

Problems to be Solved by the Invention

In the lamp disclosed in Patent Document 1, at a high-beam irradiation, an additional high-beam light distribution pattern is added to a low-beam light distribution pattern. In the configuration of the lamp disclosed in Patent Document 1, at a high-beam irradiation, a dark portion may occur between the low-beam light distribution pattern and the additional high-beam light distribution pattern. This dark portion causes unnatural feeling to a driver.

In the lamp disclosed in Patent Document 1, at a high-beam irradiation, an additional high-beam light distribution pattern is added to a low-beam light distribution pattern. In the configuration of the lamp disclosed in Patent Document 1, an arrangement location of a light source (high-beam light source) configured to emit light for forming the additional high-beam light distribution pattern should be determined in a limited design space so as to avoid a path of light for forming the low-beam light distribution pattern. Therefore, the utilization efficiency of light emitted from the high-beam light source may be lowered.

In the lamp disclosed in Patent Document 1, at a high-beam irradiation, an additional high-beam light distribution pattern is added to a low-beam light distribution pattern. In the configuration of the lamp disclosed in Patent Document 1, during operation, a light source (high-beam light source) configured to emit light for forming the additional high-beam light distribution pattern may be exposed for a long time to a high temperature equal to or higher than the product conditions, for example In this case, the performance of the light source is degraded and the product life of the vehicle lamp decreases.

Accordingly, a first object of the disclosure is to provide a vehicle lamp capable of reducing unnatural feeling to be caused to a driver at a high-beam irradiation.

A second object of the disclosure is to provide a vehicle lamp capable of improving the utilization efficiency of light of a light source configured to emit light for forming an additional high-beam light distribution pattern.

A third object of the disclosure is to provide a vehicle lamp and a substrate capable of reducing a decrease in the product life.

Means for Solving the Problems

A vehicle lamp according to a first aspect of the disclosure is configured to selectively perform a low-beam irradiation and a high-beam irradiation. The vehicle lamp includes:

a projector lens;

a first light source disposed behind the projector lens and configured to emit light for forming a low-beam light distribution pattern;

a second light source disposed behind the projector lens and configured to emit light for forming an additional high-beam light distribution pattern;

a shade disposed behind the projector lens and configured to form a cutoff line of the low-beam light distribution pattern; and an optical path change portion configured to change an optical path of a part of light emitted from the second light source so as to travel toward a portion between the low-beam light distribution pattern and the additional high-beam light distribution pattern.

Since a tip end of the shade cannot reflect light, the tip end causes a dark portion between the low-beam light distribution pattern and the additional high-beam light distribution pattern. However, it is not possible to physically reduce the thickness of the tip end to zero.

According to the above configuration, the optical path of the part of the light emitted from the second light source is changed toward the portion between the low-beam light distribution pattern and the additional high-beam light distribution pattern. Accordingly, the dark portion occurring due to the tip end of the shade can be less noticeable, thereby reducing unnatural feeling to be caused to a driver at a high-beam irradiation.

In the vehicle lamp according to the first aspect of the disclosure, the optical path change portion may be formed in a region of an exit surface of the projector lens where an emission rate of light emitted from the second light source is higher than that of light emitted from the first light source.

According to the above configuration, the optical path of the light emitted from the second light source can be changed by the optical path change portion, and the dark portion occurring due to the tip end of the shade can be further less noticeable.

In the vehicle lamp according to the first aspect of the disclosure, the optical path change portion may be formed as a texture on the region of the exit surface.

According to the above configuration, the optical path of the light emitted from the second light source can be changed into a predetermined direction, and the dark portion occurring due to the tip end of the shade can be further less noticeable.

In the vehicle lamp according to the first aspect of the disclosure, the optical path change portion may be formed as a lens step on the region of the exit surface.

Further, in the vehicle lamp according to the first aspect of the disclosure, the optical path change portion may be formed in a region of an incident surface of the projector lens where an incident rate of light emitted from the second light source is higher than that of light emitted from the first light source.

According to the above configuration, the optical path of the light emitted from the second light source can be changed by the optical path change portion, and the dark portion occurring due to the tip end of the shade can be less noticeable. Further, the dark portion occurring due to the tip end of the shade can be less noticeable.

In the vehicle lamp according to the first aspect of the disclosure, the optical path change portion may be formed as a lens step on the region of the incident surface.

According to the above configuration, the optical path of the light emitted from the second light source can be changed into a predetermined direction, and the dark portion occurring due to the tip end of the shade can be less noticeable.

In the vehicle lamp according to the first aspect of the disclosure, the optical path change portion may be formed as a texture on the region of the incident surface.

In the vehicle lamp according to the first aspect of the disclosure, the optical path change portion may be formed in a region between the projector lens and the second light source where a passing rate of light emitted from the second light source is higher than that of light emitted from the first light source.

According to the above configuration, the optical path of the light emitted from the second light source can be changed by the optical path change portion, and the dark portion occurring due to the tip end of the shade can be further less noticeable.

In the vehicle lamp according to the first aspect of the disclosure, the optical path change portion may include an additional optical member provided in the region.

According to the above configuration, the optical path of the light emitted from the second light source can be changed into a predetermined direction, and the dark portion occurring due to the tip end of the shade can be further less noticeable.

In the vehicle lamp according to the first aspect of the disclosure, the second light source may include a plurality of light emitting elements, and the plurality of light emitting elements may be arranged in a left-right direction below a rear focal point of the projector lens and may be configured to be individually turned on.

According to the above configuration, in the lamp capable of forming the additional high-beam light distribution pattern with a plurality of types of irradiation patterns by selectively turning on some of the plurality of light emitting elements, the dark portion occurring due to the tip end of the shade can be further less noticeable.

A vehicle lamp according to a second aspect of the disclosure is configured to selectively perform a low-beam irradiation and a high-beam irradiation. The vehicle lamp includes:

a projector lens;

a first light source disposed behind the projector lens and configured to emit light for forming a low-beam light distribution pattern;

a second light source disposed behind the projector lens and configured to emit light for forming an additional high-beam light distribution pattern;

a base member on which the first light source and the second light source are disposed; and an optical member being a member separate from the base member and configured to serve as a shade for forming a cutoff line of the low-beam light distribution pattern in a state of being attached to the base member.

In the case where a shade portion is integrally formed at a tip end of the base member, the tip end has a certain thickness clue to the limitation in the processing conditions of the base member. Since the tip end cannot reflect light, the tip end causes a dark portion.

According to the above configuration, since the optical member is a member separate from the base member, the shape of the tip end of the optical member can be formed thinner without being limited by the processing conditions of the base member. Therefore, the thickness of the tip end, which causes a dark portion, can be made smaller than a conventional one. Accordingly, the occurrence of a dark portion can be reduced to an extent that is less noticeable from a driver.

In the vehicle lamp according to the second aspect of the disclosure, in a state where the optical member is attached to the base member, the optical member may serve as a shade for forming a cutoff line of the low-beam light distribution pattern and also serve as a reflector for reflecting at least a part of light emitted from the second light source toward the projector lens.

According to the above configuration, since the optical member can be also used as the reflector, the optical member can contribute to improving the utilization efficiency of the light of the second light source.

In the vehicle lamp according to the second aspect of the disclosure, an opening portion may be formed in the optical member, and in a state where the optical member is attached to the base member, the second light source may be exposed from the opening portion toward the front of the lamp According to the above configuration, the second light source can be easily disposed in the vicinity of a rear focal point of the projector lens, and the utilization efficiency of direct light emitted from the second light source can be enhanced.

In the vehicle lamp according to the second aspect of the disclosure, the optical member may be formed with an upper plate portion above the opening portion, and an upper surface of the upper plate portion may include a first reflective surface configured to reflect light emitted from the first light source toward the projector lens.

According to the above configuration, since the upper plate portion constituting the optical member can be also used as a reflective surface of the light emitted from the first light source, the upper plate portion can contribute to improving the utilization efficiency of light of the first light source.

In the vehicle lamp according to the second aspect of the disclosure, a lower surface of the upper plate portion on a side opposite to the upper surface may include a second reflective surface configured to reflect light emitted from the second light source toward the projector lens.

According to the above configuration, since the upper plate portion constituting the optical member can be also used as a reflective surface of light emitted from the second light source, the upper plate portion can contribute to improving the utilization efficiency of light of the second light source.

In the vehicle lamp according to the second aspect of the disclosure, a tip end of the upper plate portion in a front-rear direction of the lamp may be configured to form a cutoff line of the low-beam light distribution pattern.

According to the above configuration, the upper plate portion constituting the optical member can be also used as a member for forming the cutoff line.

In the vehicle lamp according to the second aspect of the disclosure, the optical member may be formed with a lower plate portion below the opening in the optical member, and an upper surface of the lower plate portion may include a third reflective surface configured to reflect light emitted from the second light source toward the projector lens.

According to the above configuration, since the lower plate portion constituting the optical member can be also used as a reflective surface of light emitted from the second light source, the lower plate portion can contribute to improving the utilization efficiency of light of the second light source.

In the vehicle lamp according to the second aspect of the disclosure, the second light source may include a light emitting element and a substrate on which the light emitting element is disposed, an upper end portion of the substrate may be arranged above an optical axis of the projector lens, and the vehicle lamp may include a cover member covering the upper end portion from above and configured to reflect light emitted from the first light source toward the projector lens.

According to the above configuration, the second light source can be easily arranged in the vicinity of the rear focal point of the projector lens.

In the vehicle lamp according to the second aspect of the disclosure, the second light source may include a light emitting element and a substrate on which the light emitting element is disposed, the base member may include a first surface on which the first light source is disposed and a second surface to which the substrate of the second light source is fixed, and in a state where the optical member is attached to the base member, a gap in which an upper end portion of the substrate enters may be formed between the optical member and a tip end of the first surface in the front-rear direction of the lamp.

According to the above configuration, the degree of freedom in arranging the substrate is improved by using the gap. For example, the upper end portion of the substrate can be arranged above the optical axis through the gap, and the second light source can be easily arranged in the vicinity of the rear focal point of the projector lens.

In the vehicle lamp according to the second aspect of the disclosure, the substrate may be interposed between the base member and the optical member and may be fixed, together with the optical member, to the base member by a fixing member.

According to the above configuration, the second light source can be easily arranged on the substrate at a position close to the rear focal point of the projector lens.

In the vehicle lamp according to the second aspect of the disclosure, the optical member may be formed of a transparent polycarbonate resin.

According to the above configuration, the optical member can be prevented from being melted and damaged by the condensation of sunlight.

A vehicle lamp according to a third aspect of the disclosure is configured to selectively perform a low-beam irradiation and a high-beam irradiation. The vehicle lamp includes:

a projector lens;

a first light source disposed behind the projector lens and configured to emit light for forming a low-beam light distribution pattern;

a second light source disposed behind the projector lens and configured to emit light for forming an additional high-beam light distribution pattern; and a base member on which the first light source and the second light source are disposed;

wherein the base member includes a first surface on which the first light source is disposed and a second surface on which the second light source is disposed, and wherein the second surface is an inclined surface inclined with respect to an optical axis of the projector lens such that an emission portion of the second light source disposed on the second surface faces obliquely forward and upward and the emission portion of the second light source is disposed below a rear focal point of the projector lens.

According to the above configuration, most of light emitted from the second light source is allowed to pass through the vicinity of the rear focal point while placing the second light source at a position avoiding a path of light for forming the low-beam light distribution pattern. Therefore, the utilization efficiency of light of the second light source can be improved.

In the vehicle lamp according to the third aspect of the disclosure, the second light source may include a plurality of light emitting elements and a substrate on which the plurality of light emitting elements are disposed, the substrate may be fixed to the inclined surface, and the plurality of light emitting elements may be arranged on the inclined surface via the substrate.

According to the above configuration, most of light emitted from the plurality of light emitting elements disposed on the substrate is allowed to pass through the vicinity of the rear focal point.

In the vehicle lamp according to the third aspect of the disclosure, an upper end portion of the substrate may be disposed above the optical axis of the projector lens.

According to the above configuration, the plurality of light emitting elements disposed on the substrate can be brought closer to the rear focal point.

The vehicle lamp according to the third aspect of the disclosure may include an optical member serving as a shade for forming a cutoff line of the low-beam light distribution pattern in a state of being attached to the base member, the optical member may include an opening portion, and the plurality of light emitting elements may be exposed from the opening portion toward the front of the lamp.

According to the above configuration, the plurality of light emitting elements can be arranged closer to the rear focal point.

In the vehicle lamp according to the third aspect of the disclosure, the plurality of light emitting elements may be exposed from the opening portion toward the front of the lamp, may be arranged in a left-right direction below the rear focal point of the projector lens and may be configured to be individually turned on.

According to the above configuration, the utilization efficiency of light of each light emitting element can be improved in the plurality of light emitting elements which can be individually turned.

A vehicle lamp according to a fourth aspect of the disclosure includes:

a projector lens; and a light source disposed behind the projector lens and configured to emit light for forming a predetermined light distribution pattern;

wherein the light source includes a plurality of light emitting elements and a metal substrate on which the plurality of light emitting elements are arranged, wherein a plurality of wiring patterns and mounting portions formed respectively for the wiring patterns are formed on the substrate, wherein the light emitting elements are connected to the mounting portions, and each light emitting element is configured to be individually turned on, and wherein when a shortest distance between the mounting portions and end portions of the wiring patterns is defined as A, a shortest distance between the mounting portions and an end portion of the substrate is defined as B, and a minimum arrangement pitch between the plurality of light emitting elements is defined as Pmin, a ratio (A/Pmin) of the shortest distance A to the minimum arrangement pitch Pmin is 0.57 or more, and a ratio (B/Pmin) of the shortest distance B to the minimum arrangement pitch Pmin is 1.7 or more.

According to the above configuration, the light emitting elements are prevented from being heated to, for example, a temperature equal to or higher than the product condition even when the light source is operated for a certain time or more. Therefore, a decrease in the product life of the vehicle lamp can be reduced.

The vehicle lamp according to the fourth aspect of the disclosure may include a metal base member on which the light source is disposed, the substrate may be fixed to the base member, and the plurality of light emitting elements may be arranged on the base member via the substrate.

According to the above configuration, heat generated from the light source can be radiated from the base member via the substrate.

The vehicle lamp according to the fourth aspect of the disclosure is configured to selectively perform a low-beam irradiation and a high-beam irradiation, and the light source may be provided to emit light for forming an additional high-beam light distribution pattern.

According to the above configuration, the light source can be used to form the additional high-beam light distribution pattern.

In the vehicle lamp according to the fourth aspect of the disclosure, in a state where the substrate is fixed on the base member, an end portion of the substrate may serve as a shade for forming a cutoff line of the low-beam light distribution pattern.

According to the above configuration, the light emitting elements can be easily arranged in the vicinity of the rear focal point of the projector lens, and the utilization efficiency of light of the light source can be improved. Further, since a part of the substrate can be used as a shade, the number of parts can be reduced.

The vehicle lamp according to the fourth aspect of the disclosure may include a shade disposed behind the projector lens and configured to form a cutoff line of the low-beam light distribution pattern, wherein the plurality of light emitting elements may be arranged within 5 mm from a tip end of the shade toward a rear of the lamp in a front-rear direction of the lamp and may be arranged within 4 mm from the tip end of the shade toward a lower side of the lamp in an upper-lower direction of the lamp.

According to the above configuration, a better additional high-beam light distribution pattern can be obtained in which unevenness is reduced while securing brightness.

A substrate according to the fourth aspect of the disclosure which is used for a vehicle lamp includes:

a plurality of light emitting elements; and a metal substrate on which the plurality of light emitting elements are arranged, wherein a plurality of wiring patterns and mounting portions formed respectively for the wiring patterns are formed on the substrate, wherein the light emitting elements are connected to the mounting portions and each of the plurality of light emitting elements is configured to be individually turned on, and wherein when a shortest distance between the mounting portions and end portions of the wiring patterns is defined as A, a shortest distance between the mounting portions and an end portion of the substrate is defined as B, and a minimum arrangement pitch between the plurality of light emitting elements is defined as Pmin, a ratio (A Pmin) of the shortest distance A to the minimum arrangement pitch Pmin is 0.57 or more, and a ratio (B/Pmin) of the shortest distance B to the minimum arrangement pitch Pmin is 1.7 or more.

According to the above configuration, the light emitting elements are prevented from being heated to, for example, a temperature equal to or higher than the product condition even when the light emitting elements are operated for a certain time or more. Therefore, a decrease in the product life of the vehicle lamp can be reduced.

Effects of the Invention

According to the vehicle lamp of the first aspect and the vehicle lamp of the second aspect of the disclosure, the vehicle lamp can be provided which is capable of reducing unnatural feeling to be caused to a driver at a high-beam irradiation.

Further, according to the vehicle lamp of the third aspect of the disclosure, the utilization efficiency of light can be improved in the light source configured to emit light for forming the additional high-beam light distribution pattern.

Further, according to the vehicle lamp and the substrate of the fourth aspect of the disclosure, a decrease in the product life can be reduced.

DESCRIPTION OF EMBODIMENTS

<First Embodiment>

Figure 1:
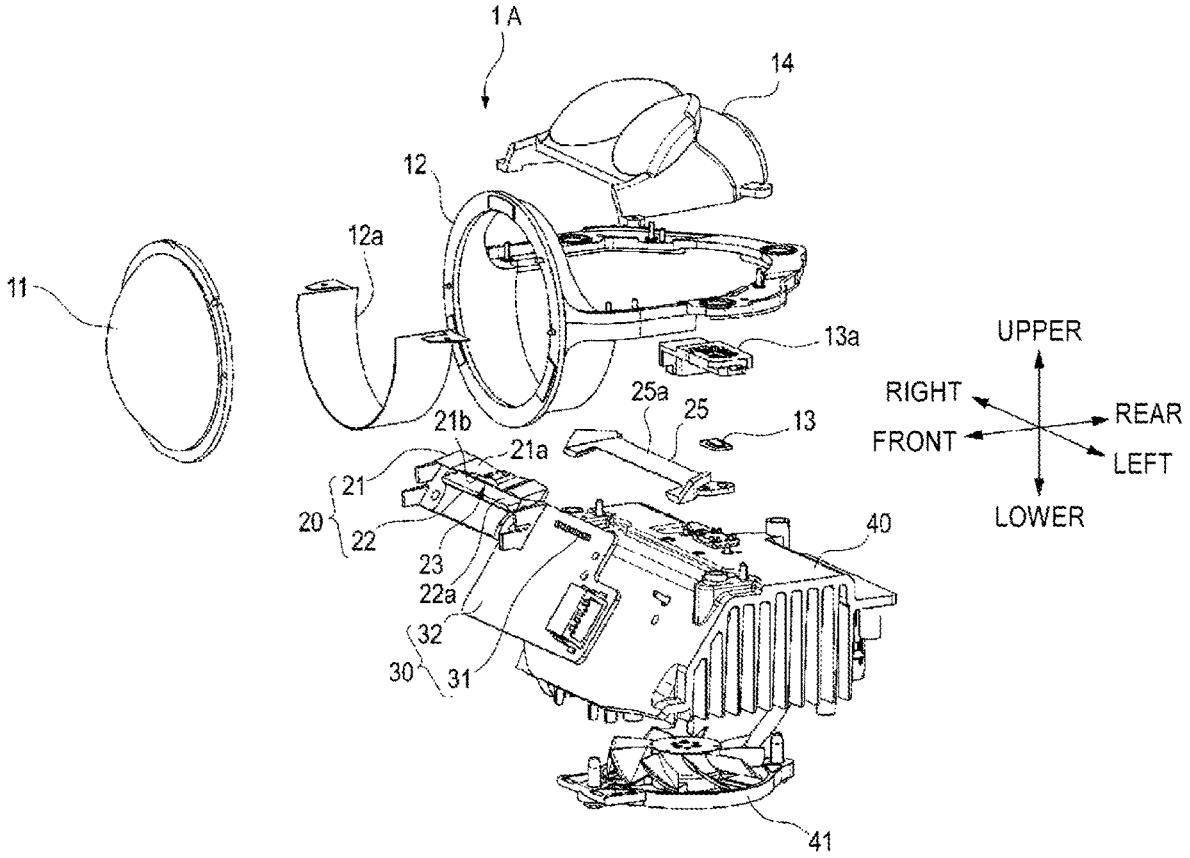
FIG. 1 is an exploded perspective view of a vehicle lamp according to a first embodiment of the disclosure.
Figure 2:
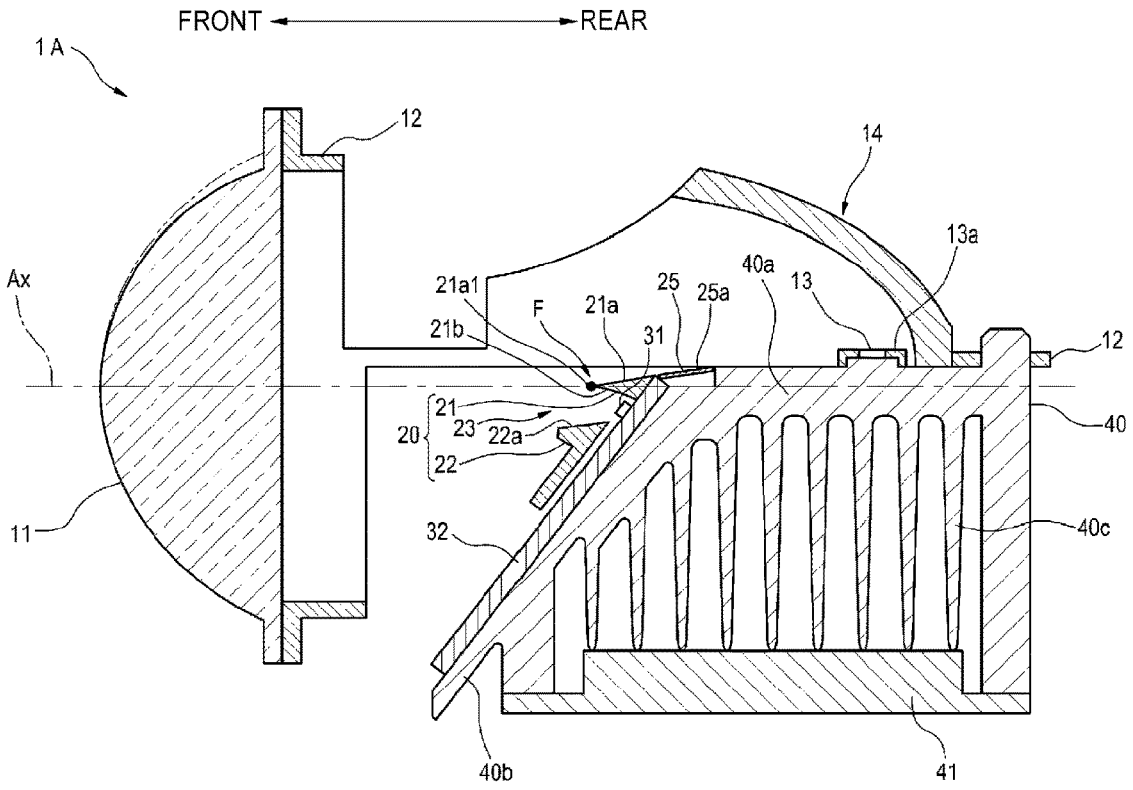
FIG. 2 is a view showing a vertical cross section of the lamp of FIG. 1, as viewed from a horizontal direction.

Hereinafter, as an example of a vehicle lamp 1 of the disclosure, a vehicle lamp of a first embodiment will be described in detail with reference to the drawings. As shown in FIGS. 1 and 2, a vehicle lamp 1A includes a projector lens 11, a lens holder 12, a light emitting element (an example of a first light source) 13, a reflector 14, an optical member (an example of a shade) 20, a reflective member 25, a light source unit (an example of a second light source) 30, a base member 40, and a fan 41. Meanwhile, in FIG. 2, for ease of view, the shape of the reflector 14 is shown in a simplified manner.

The vehicle lamp 1A is, for example, a headlamp capable of selectively performing a low-beam irradiation and a high-beam irradiation and is configured as a projector type lamp unit.

The projector lens 11 has an optical axis Ax extending in a front-rear direction of a vehicle. The projector lens 11 is a plano-convex aspheric lens having a front convex surface and a rear flat surface. The projector lens 11 is configured to project a light source image formed on a rear focal plane which is a focal plane including a rear focal point F thereof, as an inverted image, on a virtual vertical screen in front of the lamp. In the present embodiment, the virtual vertical screen is disposed, for example, at a position of 25 m in front of the vehicle. Meanwhile, both the front surface and the rear surface of the projector lens 11 may be convex. The projector lens 11 is supported by the lens holder 12 at its outer peripheral flange portion. The lens holder 12 for supporting the projector lens 11 is supported on the base member 40. An extension 12*a* for concealing an inner wall surface of the lens holder 12 so as not to be visible from the outside is attached to the lens holder 12.

The light emitting element 13 is disposed behind the rear focal point F of the projector lens 11. The light emitting element 13 is configured by, for example, a white light emitting diode and has a laterally elongated rectangular light emitting surface. The light emitting element 13 is disposed upward with its light emitting surface positioned slightly above a horizontal plane including the optical axis Ax. The light emitting element 13 is fixed to the base member 40 via an attachment 13*a*. Light emitted from the light emitting element 13 is mainly incident on a region of a rear surface (incident surface) of the projector lens 11 positioned below the optical axis Ax and is emitted from an exit surface, thereby forming a low-beam light distribution pattern.

Meanwhile, in the present embodiment, the "low-beam light distribution pattern" and the "additional high-beam light distribution pattern" (to be described later) mean light distribution patterns formed on a virtual vertical screen disposed, for example, at a position of 25 m in front of the vehicle. Further, the portion "between the low-beam light distribution pattern and the additional high-beam light distribution pattern" means the portion between both of the light distribution patterns formed on the virtual vertical screen.

The reflector 14 is disposed so as to cover the light emitting element 13 from the upper side and configured to reflect light from the light emitting element 13 toward the projector lens 11. A reflective surface of the reflector 14 for reflecting light has an axis connecting the rear focal point F and a light emission center of the light emitting element 13. The reflective surface is formed by a substantially elliptical curved surface having the light emission center of the light emitting element 13 as a first focal point. The reflective surface is set such that its eccentricity gradually increases from a vertical cross section toward a horizontal cross section. The reflector 14 is supported by the lens holder 12.

The light source unit 30 includes a plurality of light emitting elements 31 and a substrate 32.

The light emitting elements 31 are arranged in a left-right direction at the lower rear side of the rear focal point F of the projector lens 11. Each of the light emitting elements 31 is configured by, for example, a white light emitting diode and has a square light emission surface, for example. The light emitting elements 31 are mounted on the substrate 32 in a state where its light emission surface is inclined upward with respect to the front direction of the lamp. The substrate 32 on which the light emitting elements 31 are mounted is supported on the base member 40.

In the present embodiment, eleven light emitting elements 31 are arranged on the substrate 32. For example, the light emitting elements 31 is arranged at equal intervals in the left-right direction and centered on the position directly below the optical axis Ax. Each of the light emitting elements 31 can be individually tuned on by a lighting control circuit provided on the substrate 32. Light emitted from the light emitting elements 31 is incident on substantially the entire area of an incident surface of the projector lens 11 and emitted from an exit surface, thereby forming an additional high-beam light distribution pattern.

The light of each light emitting element 31 directed toward the projector lens 11 passes through its rear focal plane with a certain extent. The range of the bundle of light beams slightly overlaps between adjacent light emitting elements. Meanwhile, the light emitting elements 31 may not be arranged in a bilaterally symmetrical manner with respect to the position directly below the optical axis Ax. Further, the light emitting elements 31 may not be arranged at equal intervals.

The optical member 20 has a plate-shaped upper plate portion 21 and a plate-shaped lower plate portion 22 arranged in parallel in a substantially horizontal manner with a predetermined interval in an upper-lower direction. A predetermined spaced interval between the upper plate portion 21 and the lower plate portion 22 serves as an opening 23 in which the light emitting elements 31 of the light source unit 30 are disposed. The light emitting elements 31 are arranged so as to be exposed from the opening 23 toward the front of the lamp. The optical member 20 is formed of aluminum die cast or transparent polycarbonate resin or the like having excellent heat resistance. The optical member 20 is supported, together with the light source unit 30, on the base member 40.

An upper surface of the upper plate portion 21 constitutes an upward reflective surface 21*a* which shields a part of light emitted from the light emitting element 13 and reflected by the reflector 14 and then reflects the shielded light upward. The upward reflective surface 21*a* allows the reflected light to be incident on an incident surface of the projector lens 11 and allows the incident light to be emitted from a front surface (exit surface) of the projector lens 11. The upward reflective surface 21*a* is formed so as to be inclined slightly forward and downward with respect to a horizontal plane including the optical axis Ax. A left area of the upward reflective surface 21*a* located on the left side (the right side in the front view of the lamp) of the optical axis Ax is configured by an inclined surface inclined obliquely upward and rearward from the position of the horizontal plane including the optical axis Ax. A right area of the upward reflective surface 21*a* located on the right side (the left side in the front view of the lamp) of the optical axis Ax is configured by an inclined surface which is lower than the left area by one step via a short inclined surface. A front end edge 21*a*1 of the upward reflective surface 21*a* is formed so as to extend from the position of the rear focal point F toward the left and right sides.

A lower surface of the upper plate portion 21 on the side opposite to the upper surface constitutes a downward reflective surface 21*b* which reflects a part of light emitted obliquely upward and forward from the light emitting elements 31 toward the projector lens 11 on the front side. The downward reflective surface 21*b* is formed so as to extend rearward and slightly downward from the front end edge 21*a*1 of the upward reflective surface 21*a* to a position near upper portions of the light emitting elements 31.

An upper surface of the lower plate portion 22 constitutes a reflective surface 22*a* which reflects a part of light emitted obliquely downward and forward from the light emitting elements 31 toward the projector lens 11 on the front side. The reflective surface 22*a* is formed so as to extend rearward and slightly upward from an obliquely lower front side of the light emitting elements 31 to a position near lower portions of the light emitting elements 31.

The upward reflective surface 21*a* and the downward reflective surface 21*b* of the upper plate portion 21 and the reflective surface 22*a* of the lower plate portion 22 are mirror-finished by aluminum vapor deposition or the like.

The reflective member 25 is disposed behind the upper plate portion 21 so as to be continuous with the upper plate portion 21. Similar to the upper surface of the upper plate portion 21, an upper surface of the reflective member 25 constitutes an upward reflective surface 25*a* which shields a part of light emitted from the light emitting element 13 and reflected by the reflector 14 and then reflects the shielded light upward. The upward reflective surface 25*a* of the reflective member 25 is mirror-finished by aluminum vapor deposition or the like. The reflective member 25 is supported on the base member 40. Similar to the upward reflective surface 21*a*, the upward reflective surface 25*a* is formed so as to be inclined slightly forward and downward with respect to the horizontal plane including the optical axis Ax.

The base member 40 has an upper wall portion 40*a* formed in a horizontal plane and an inclined wall portion 40*b* extending obliquely downward and forward from a front end of the upper wall portion 40*a*. On the upper wall portion 40*a* and the inclined wall portion 40*b*, a plurality of heat-radiation fins 40*c* extending downward from the lower surfaces thereof is arranged side by side in the front-rear direction. The light emitting element 13 and the reflective member 25 are supported on the upper surface of the upper wall portion 40*a*. The light emitting elements 31 mounted on the substrate 32 and the optical member 20 are supported on the upper surface of the inclined wall portion 40*b*.

The fan 41 is disposed below the base member 40. The wind generated from the fan 41 is sent to the heat-radiation fins 40*c* extending downward from the lower side.

Meanwhile, in a state where the adjustment of the optical axis is completed, the vehicle lamp 1A is configured so that the optical axis Ax is provided slightly downward with respect to the front-rear direction of the vehicle, for example.

Figure 3:
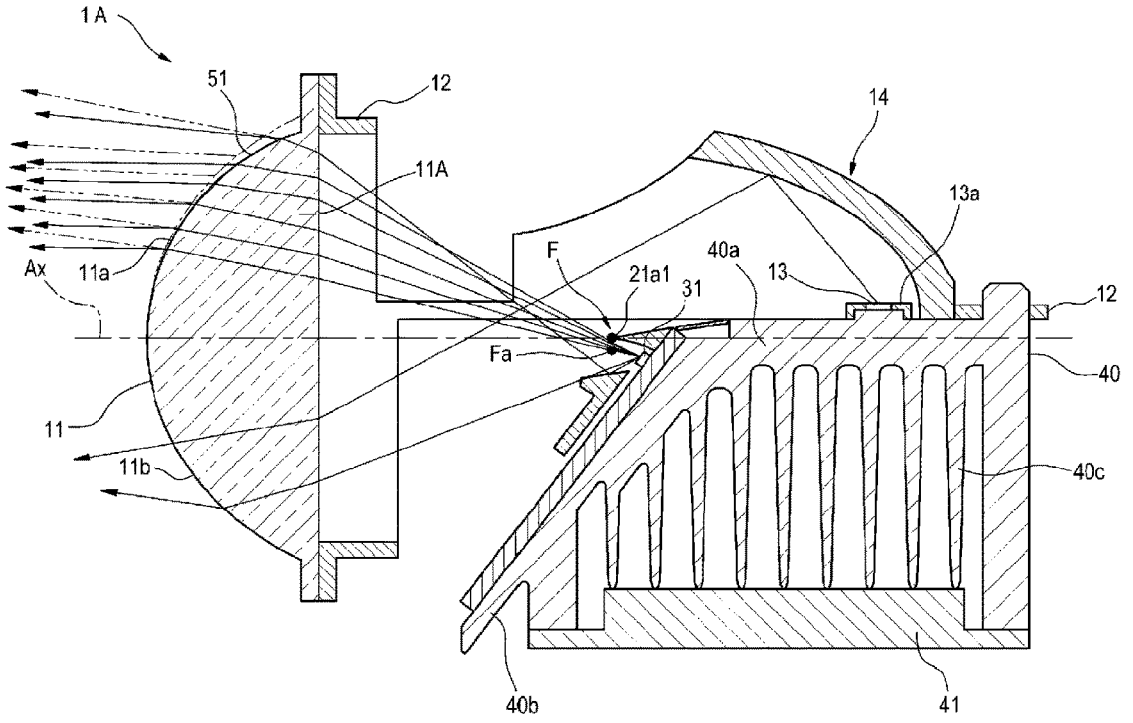
FIG. 3 is a view showing an optical path in the vehicle lamp according to the first embodiment.

In the vehicle lamp 1A having such a configuration, as shown in FIG. 3, an optical path change portion 51 is formed in an upper exit surface 11*a* of the projector lens 11 of the present embodiment above the optical axis Ax. That is, the optical path change portion 51 is formed in a region of the exit surface of the projector lens 11 where an emission rate of light emitted from the light emitting elements 31 is higher than that of light emitted from the light emitting element 13. The optical path change portion 51 is formed as a curvature changing processed surface in which the upper exit surface 11*a* above the optical axis Ax is greatly curved toward the rear side than a lower exit surface 11*b* below the optical axis Ax (the radius of curvature of the exit surface is reduced). Meanwhile, the region where the radius of curvature of the exit surface is changed is not necessarily limited to the entire region above the optical axis Ax, so long as it is located above the optical axis Ax.

Since the optical path change portion 51 is formed, the projector lens 11 is configured such that a rear focal point Fa of an upper region 11A located above the optical axis Ax is positioned below the rear focal point F of the region other than the upper region 11A. Therefore, the rear focal point F of the region other than the upper region 11A is located on the optical axis Ax while the rear focal point Fa of the upper region 11A is located below the optical axis Ax.

In this way, the projector lens 11 changes an optical path of the light emitted from the light emitting elements 31 and incident on the upper region 11A of the projector lens 11 so that the light travels slightly downward as compared with the case of the exit surface (indicated by the two-dot chain line in the figure). As a result, the light is emitted forward from the upper exit surface 11*a* of the projector lens 11. In the present embodiment, the light beam (direct light) directly going from the light emitting elements 31 to the upper region 11A of the projector lens 11 passes through the vicinity of the rear focal point Fa of the upper region 11A.

Meanwhile, for example, the optical path change portion 51 may be formed, as a microstructure for refracting (scattering) light, in the region of the upper exit surface 11*a*. Also in this case, the projector lens 11 changes an optical path of the light emitted from the light emitting elements 31 and incident on the upper region 11A slightly downward from the upper exit surface 11*a* and emits the light forward. Further, the microstructure as the optical path change portion 51 may be formed on the incident surface of the upper region 11A of the projector lens 11.

<Modification 1 of First Embodiment>

Next, a modification 1 of the optical path change portion 51 in the above-described embodiment will be described with reference to FIG. 4. Meanwhile, since the parts having the same reference numerals as those of the first embodiment described above have the same function, a repeated explanation thereof is omitted.

As shown in FIG. 4, an optical path change portion 61 of the modification 1 of the first embodiment is different from the optical path change portion 51 (see FIG. 3) formed on the exit surface of the projector lens 11 in that it is formed on the incident surface of the projector lens 11.

The optical path change portion 61 is formed in a region of the incident surface of the projector lens 11 where an incident ratio of light emitted from the light emitting elements 31 is higher than that of light emitted from the light emitting element 13. For example, the optical path change portion 61 is formed, as a lens step, on an upper incident surface 11B of the projector lens 11 above the optical axis Ax. Meanwhile, when a lens step 61 is formed above the optical axis Ax, the lens step 61 is not necessarily formed in the entire region on the upper side and may be formed in a partial region. Further, the lens step as the optical path change portion 61 may be provided above the exit surface of the projector lens 11.

Figure 4A:
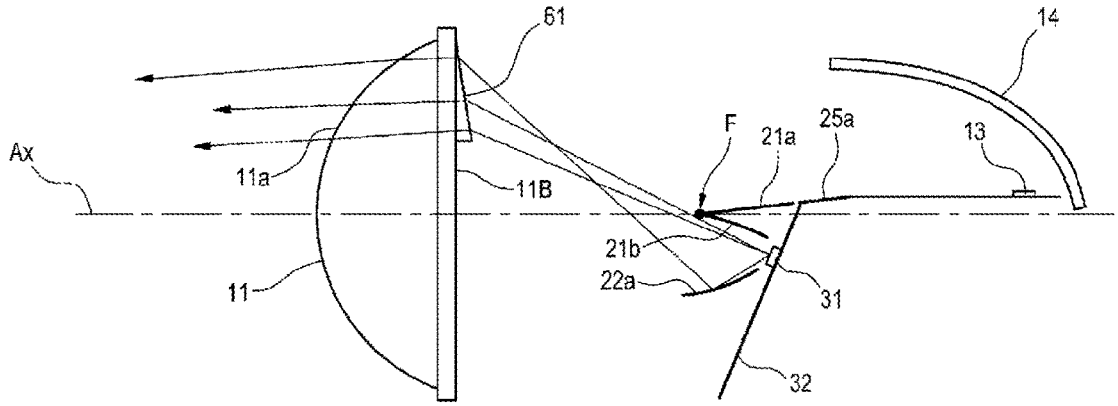
FIGS. 4A and 4B are views corresponding to FIG. 2, showing a longitudinal sectional view of the vehicle lamp for explaining an optical path change portion of a modification 1 of the first embodiment.
Figure 4B:
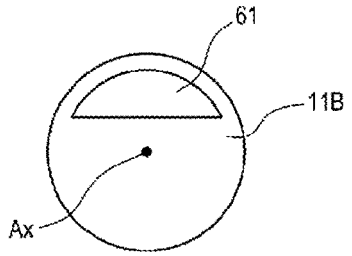

For example, the shape of the lens step 61 has a triangular cross section as shown in FIG. 4A and has an arc shape as shown in FIG. 4B, when viewed from the incident surface of the projector lens 11. The lens step 61 is disposed so that a side surface (surface on which light is incident) on the light source side is inclined with respect to the incident surface of the projector lens 11 perpendicular to the optical axis Ax.

Figure 5A:
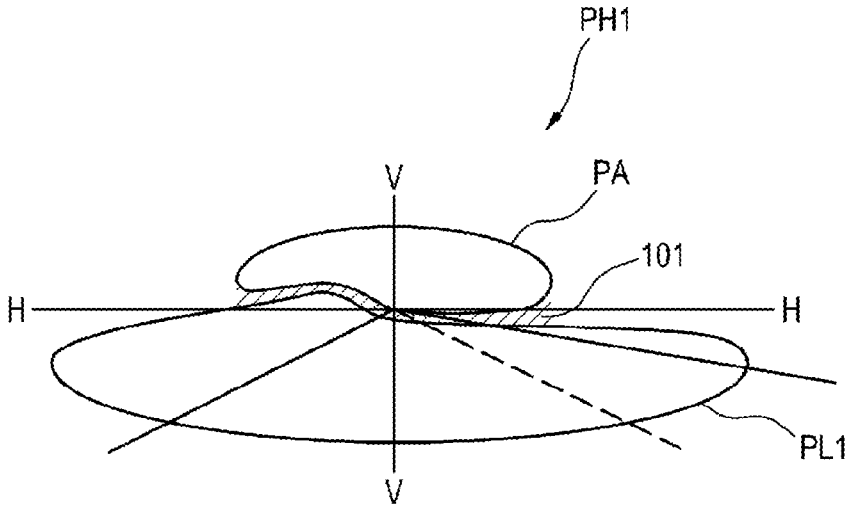
FIG. 5A shows an example of a light distribution pattern of a conventional vehicle lamp.
Figure 5B:
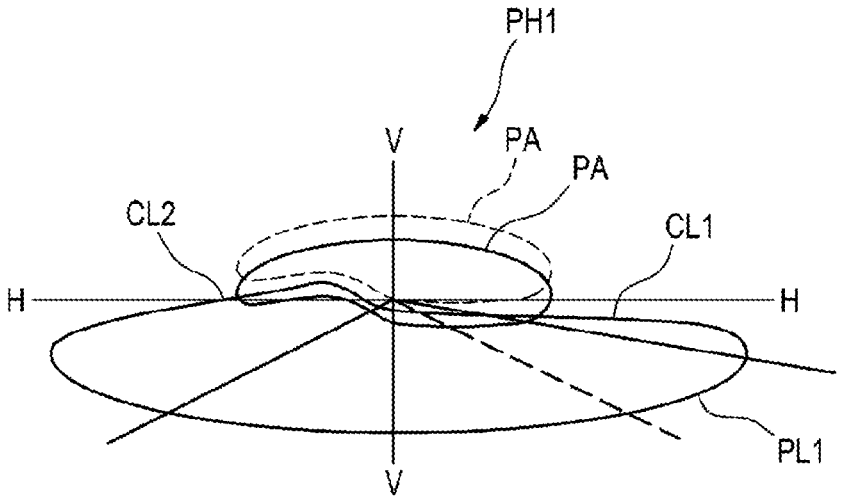
FIG. 5B shows an example of a light distribution pattern of the vehicle lamp of the first embodiment.

According to such a configuration, the light (in which the ratio of light from the light emitting elements 31 is high) emitted from the light source and incident on the lens step 61 is refracted slightly downward at the lens step 61 and then is incident on the projector lens 11. Therefore, the light incident on the lens step 61 is emitted slightly downward from the upper exit surface 11 a above the optical axis Ax, as compared with the case where the lens step 61 is not formed. In this manner, similar to the above-described embodiment, as shown in FIG. 5B, it is possible to enhance the continuity between a low-beam light distribution pattern PL1 and an additional light distribution pattern PA. As a result, the occurrence of a dark portion appearing at a high-beam irradiation can be reduced, thereby reducing unnatural feeling to be caused to a driver.

<Modification 2 of First Embodiment>

Next, a modification 2 of the optical path change portion 51 in the above-described embodiment will be described with reference to FIG. 6. Meanwhile, since the parts having the same reference numerals as those of the first embodiment described above have the same function, a repeated explanation thereof is omitted.

Figure 6:
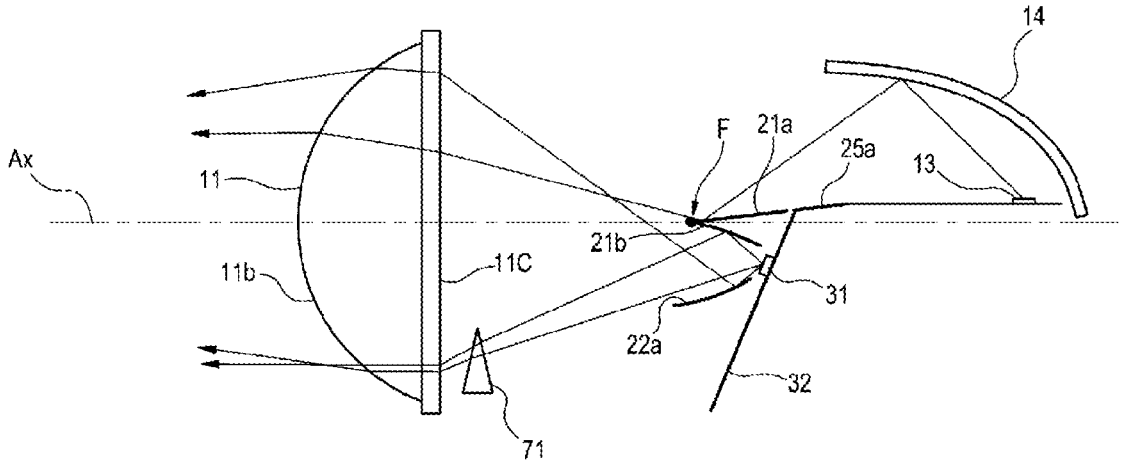
FIG. 6 is a view corresponding to FIG. 2, showing a longitudinal sectional view of the vehicle lamp for explaining an optical path change portion of a modification 2 of the first embodiment.

As shown in FIG. 6, an optical path change portion 71 of the modification 2 of the first embodiment is different from the optical path change portion 51 (see FIG. 3) formed on the exit surface of the projector lens 11 in that it is formed on the light source side (rear side) from the incident surface of the projector lens 11.

The optical path change portion 71 is formed between the projector lens 11 and the light emitting elements 31 and at a portion where a passing ratio of light emitted from the light emitting elements 31 is lower than that of light emitted from the light emitting element 13. For example, the optical path change portion 71 is formed as an additional optical member (e.g., a prism lens) at a portion which is located between the light emitting elements 31 and a lower incident surface 11C of the projector lens 11 below the optical axis Ax and through which the light from the light emitting element 13 hardly passes.

The prism lens (an example of an additional optical member) serving as the optical path change portion 71 is made of a glass material, a plastic material, or the like. The shape of the prism lens has a triangular cross section as shown in FIG. 6, for example According to such a configuration, a part (in which the ratio of light from the light emitting elements 31 is low) of the light emitted from the light source is incident on the prism lens, is refracted slightly downward, and then, is incident on the lower incident surface 11C of the projector lens 11. Therefore, the light passing through the prism lens and incident on the lower incident surface 11C is emitted slightly downward from the lower exit surface 11*b* as compared with the light which does not pass through the prism lens. In this manner, as shown in FIG. 5B, in the case of a high-beam light distribution pattern PH1, the light of the additional light distribution pattern PA is irradiated below a line H, and the low-beam light distribution pattern PL1 and the additional light distribution pattern PA can be partially overlapped at cutoff lines CL1, CL2. Therefore, it is possible to enhance the continuity between the low-beam light distribution pattern PL1 and the additional light distribution pattern PA. As a result, the occurrence of a dark portion (see FIG. 5A) appearing at a high-beam irradiation can be reduced, thereby reducing unnatural feeling to be caused to a driver.

<Modification 3 of First Embodiment>

Next, a modification 3 of the optical path change portion 51 in the above-described embodiment will be described with reference to FIG. 7. Meanwhile, since the parts having the same reference numerals as those of the first embodiment described above have the same function, a repeated explanation thereof is omitted.

Figure 7:
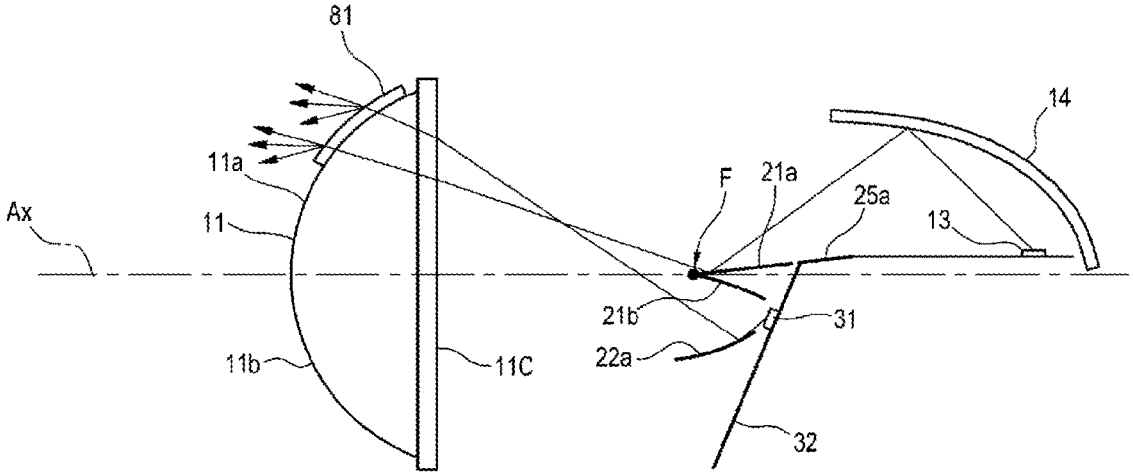
FIG. 7 is a view corresponding to FIG. 2, showing a longitudinal sectional view of the vehicle lamp for explaining an optical path change portion of a modification 3 of the first embodiment.

As shown in FIG. 7, an optical path change portion 81 of the modification 3 of the first embodiment is formed on the exit surface of the projector lens 11 as fine steps or irregularities for diffusely reflecting a part of light incident on the projector lens 11. The optical path change portion 81 also diffuses a part of the incident light obliquely upward in front of the vehicle. The diffusely reflected light forms an overhead light distribution pattern that irradiates a road sign (overhead sign) located above a road. Meanwhile, in the present embodiment, the optical path change portion 81 is formed on the upper exit surface 11*a* of the projector lens 11. However, the disclosure is not limited thereto. For example, the optical path change portion 81 may be formed on the lower exit surface 11*b*. According to such a configuration, it is possible to obtain light distribution excellent in a wide range of visibility in front of the vehicle.

<Second Embodiment>

Hereinafter, a second embodiment as an example of a vehicle lamp of the disclosure will be described in detail with reference to the drawings.

Figure 8:
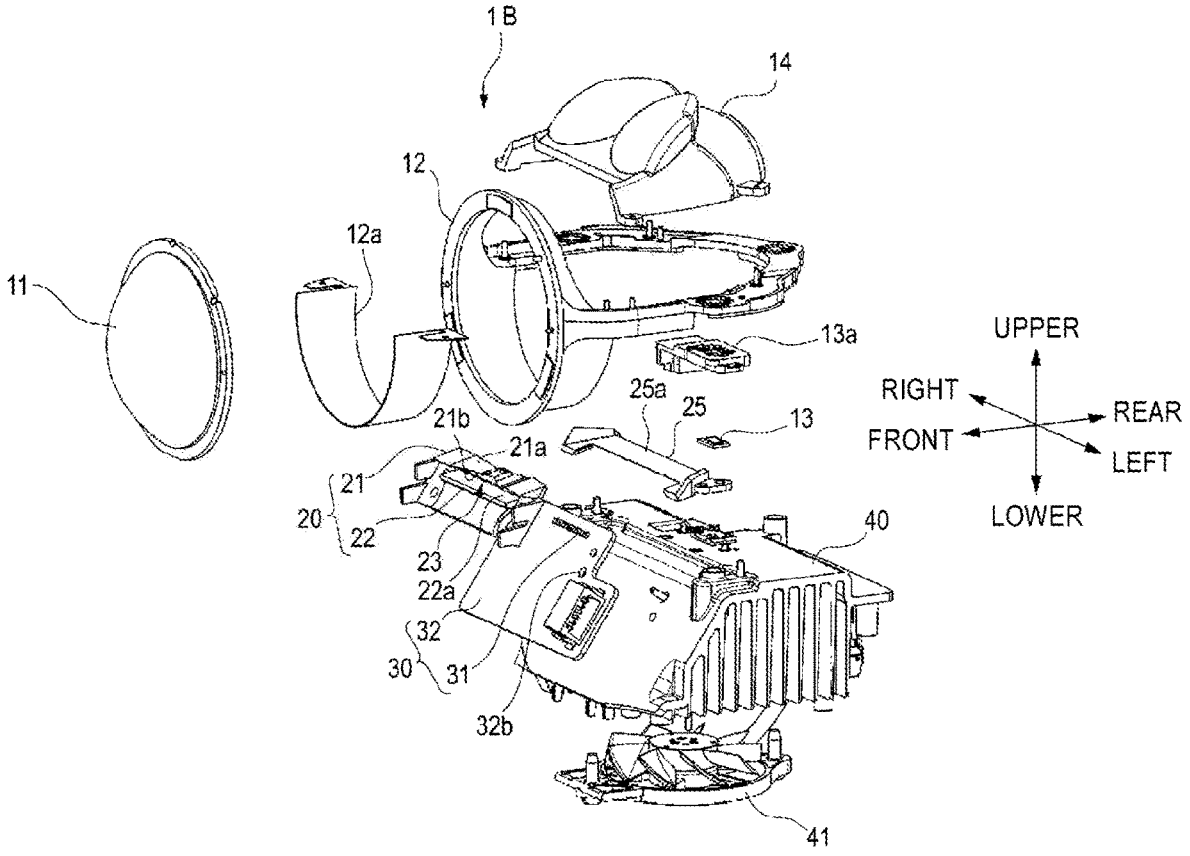
FIG. 8 is an exploded perspective view of a vehicle lamp according to a second embodiment of the disclosure.
Figure 9:
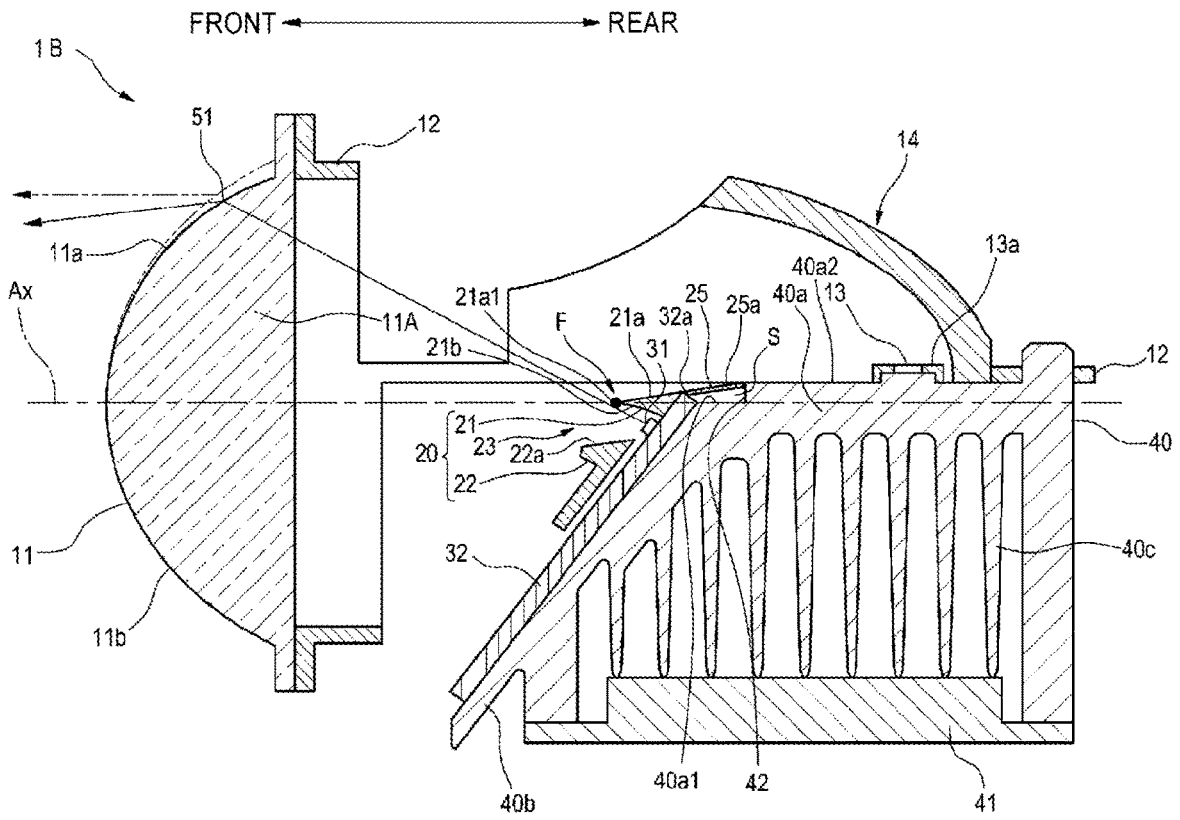
FIG. 9 is a view showing a vertical cross section of the lamp of FIG. 8, as viewed from the horizontal direction.

As shown in FIGS. 8 and 9, a vehicle lamp 1B includes the projector lens 11, the lens holder 12, the light emitting element (an example of a first light source) 13, the reflector 14, the optical member 20, the reflective member (an example of a cover member) 25, the light source unit (an example of a second light source) 30, the base member 40, and the fan 41. Meanwhile, in FIG. 9, for ease of view, the shape of the reflector 14 is shown in a simplified manner.

Similar to the first embodiment, the vehicle lamp 1B is, for example, a headlamp capable of selectively performing a low-beam irradiation and a high-beam irradiation and is configured as a projector type lamp unit.

The projector lens 11 has the optical axis Ax extending in the front-rear direction of the vehicle. The projector lens 11 is a plano-convex aspheric lens having a front convex surface and a rear flat surface. The projector lens 11 is configured to project a light source image formed on a rear focal plane which is a focal plane including the rear focal point F thereof, as an inverted image, on a virtual vertical screen in front of the lamp. Meanwhile, in the present embodiment, the virtual vertical screen is disposed, for example, at a position of 25 m in front of the vehicle. Further, both the front surface and the rear surface of the projector lens 11 may be convex.

In the projector lens 11 of the present embodiment, the optical path change portion 51 is formed in the upper exit surface 11 a above the optical axis Ax. The optical path change portion 51 is formed as a curvature processed surface which makes the radius of curvature of the upper exit surface 11*a* smaller than that of the lower exit surface 11*b* below the optical axis Ax. Since the optical path change portion 51 is formed, the light emitted from the light source unit 30 and incident on the upper region 11A of the projector lens 11 is emitted from the upper exit surface 11*a* of the projector lens 11 in a state of being directed slightly downward, as compared with the case where the optical path change portion 51 is not formed (the exit surface indicated by the two-dot chain line in the figure).

The projector lens 11 is fixed to the lens holder 12 at its outer peripheral flange portion. The lens holder 12 for fixing the projector lens 11 is fixed to the base member 40. The extension 12*a* for concealing the inner wall surface of the lens holder 12 so as not to be visible from the outside is attached to the lens holder 12. The light emitting element 13 is disposed behind the rear focal point F of the projector lens 11. The light emitting element 13 is configured by, for example, a white light emitting diode and has a laterally elongated rectangular light emitting surface. The light emitting element 13 is disposed upward with its light emitting surface positioned slightly above the horizontal plane including the optical axis Ax. The light emitting element 13 is fixed to the base member 40 via the attachment 13*a*. Light emitted from the light emitting element 13 is mainly incident on the region of the rear surface (incident surface) of the projector lens 11 positioned below the optical axis Ax and is emitted from the exit surface, thereby forming a low-beam light distribution pattern.

The reflector 14 is disposed so as to cover the light emitting element 13 from the upper side and configured to reflect light from the light emitting element 13 toward the projector lens 11. The reflective surface of the reflector 14 for reflecting light has an axis connecting the rear focal point F and the light emission center of the light emitting element 13. The reflective surface is formed by a substantially elliptical curved surface having the light emission center of the light emitting element 13 as a first focal point. The reflective surface is set such that its eccentricity gradually increases from a vertical cross section toward a horizontal cross section. The reflector 14 is fixed to the lens holder 12.

The optical member 20 has the plate-shaped upper plate portion 21 and the plate-shaped lower plate portion 22 arranged in parallel in a substantially horizontal manner with a predetermined interval in the upper-lower direction. A spaced interval between the upper plate portion 21 and the lower plate portion 22 serves as the opening 23 through which the light emitted from the light source unit 30 passes. The optical member 20 is formed of aluminum die cast or transparent polycarbonate resin or the like having excellent heat resistance. Since the optical member 20 is formed of polycarbonate resin, it is possible to reduce the deformation due to heat of sunlight.

The light source unit 30 includes the plurality of light emitting elements 31 and the substrate 32.

The light emitting elements 31 are mounted on the substrate 32 and arranged in the left-right direction at the lower rear side of the rear focal point F of the projector lens 11. Each of the light emitting elements 31 is configured by, for example, a white light emitting diode and has a square light emission surface, for example.

In the present embodiment, eleven light emitting elements 31 are arranged on the substrate 32. For example, the light emitting elements 31 are arranged at equal intervals in the left-right direction and centered on the position directly below the optical axis Ax. Each of the light emitting elements 31 can be individually tuned on by a lighting control circuit provided on the substrate 32. Light emitted from the light emitting elements 31 is incident on substantially the entire area of the incident surface of the projector lens 11 and emitted from the exit surface, thereby forming an additional high-beam light distribution pattern.

The light of each light emitting element 31 directed toward the projector lens 11 passes through its rear focal plane with a certain extent. The range of the bundle of light beams slightly overlaps between adjacent light emitting elements. Meanwhile, the light emitting elements 31 may not be arranged in a bilaterally symmetrical manner with respect to the position directly below the optical axis Ax. Further, the light emitting elements 31 may not be arranged at equal intervals.

The reflective member 25 is formed in a flat plate shape and disposed behind the upper plate portion 21 so as to be continuous with the upper plate portion 21. The upper surface of the reflective member 25 constitutes the upward reflective surface 25*a* which shields a part of light emitted from the light emitting element 13 and reflected by the reflector 14 and then reflects the shielded light toward the projector lens 11. The upward reflective surface 25*a* is mirror-finished by aluminum vapor deposition or the like. The reflective member 25 is provided so as to be inclined slightly forward and downward with respect to the horizontal plane including the optical axis Ax. Further, the reflective member 25 is disposed so as to cover an upper end portion 32*a* of the substrate 32 from above and is fixed to the base member 40. Meanwhile, the reflective member 25 may be formed integrally with the optical member 20 and constitute a part of the optical member 20.

The base member 40 has the upper wall portion 40*a* extending in the horizontal direction and the inclined wall portion 40*b* extending obliquely downward and forward from a front end of the upper wall portion 40*a*. A stepped portion 42 is formed on an upper surface of the upper wall portion 40*a*. A lower portion of the upper wall portion 40*a* on the front side of the stepped portion 42 is defined as a front upper wall portion 40*a*1, and a higher portion thereof on the rear side of the stepped portion 42 is defined as a rear upper wall portion 40*a*2. The reflective member 25 is fixed on an upper surface of the front upper wall portion 40*a*1, and the light emitting element 13 is fixed on an upper surface of the rear upper wall portion 40*a*2. Further, the optical member 20 and the light emitting elements 31 mounted on the substrate 32 are fixed to an upper surface of the inclined wall portion 40*b*. A plurality of heat-radiation fins 40*c* extends downward from lower surfaces of the upper wall portion 40*a* and the inclined wall portion 40*b* and is arranged side by side in the front-rear direction on the upper wall portion 40*a* and the inclined wall portion 40*b*. The base member 40 is arranged so that the upper surface of the front upper wall portion 40*a*1 is defined as a horizontal plane including the optical axis Ax.

The fan 41 is disposed below the base member 40. The wind generated from the fan 41 is sent to the heat-radiation fins 40*c* extending downward from the lower side.

Meanwhile, in a state where the adjustment of the optical axis is completed, the vehicle lamp 1B is configured so that the optical axis Ax is provided slightly downward with respect to the front-rear direction of the vehicle, for example.

Next, the optical member 20 will be further described with reference to FIG. 4.

Figure 10A:
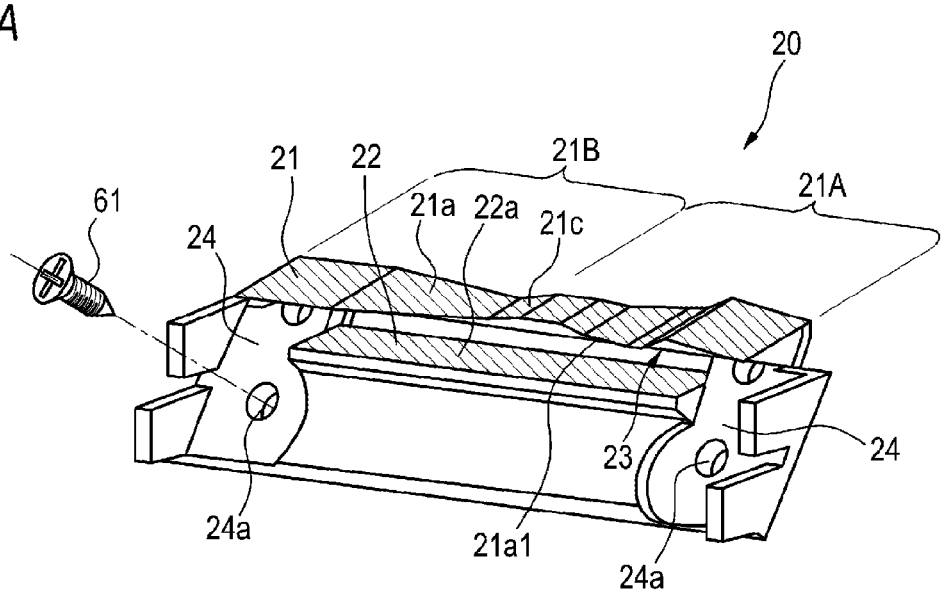
FIGS. 10A to 10C are views showing an optical member of the vehicle lamp according to the second embodiment.
Figure 10B:
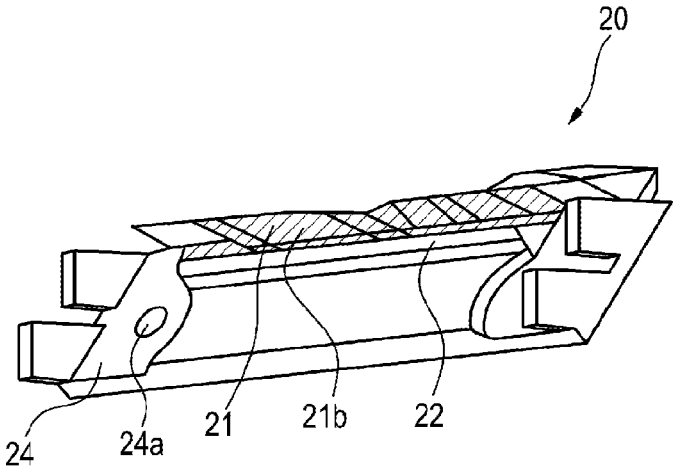
Figure 10C:
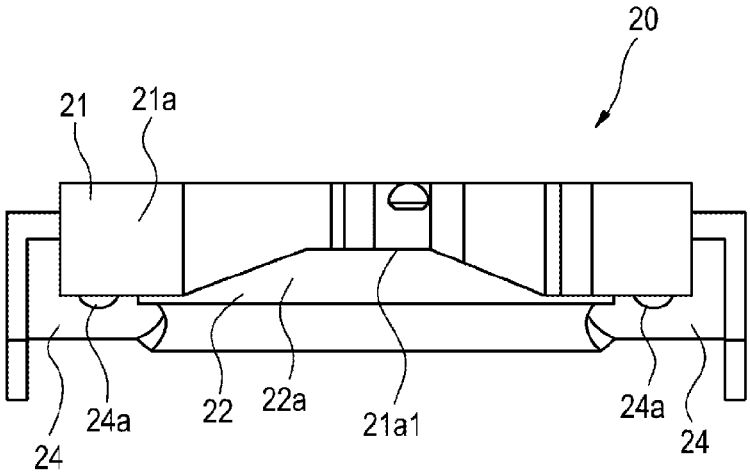

FIG. 10A is a view of the optical member 20 as viewed obliquely from the upper front side, and FIG. 10B is a view of the optical member 20 as viewed obliquely from the lower front side. Further, FIG. 10C shows a top view of the optical member 20.

An upper surface of the upper plate portion 21 constitutes a shade for shielding a part of light emitted from the light emitting element 13 and reflected by the reflector 14 and constitutes the upward reflective surface 21*a* for reflecting the shielded light toward the projector lens 11. The upward reflective surface 21*a* is formed so as to be inclined slightly forward and downward with respect to the horizontal plane including the optical axis Ax (see FIG. 9).

A left area 21A of the upward reflective surface 21*a* located on the left side (the right side in the front view of the lamp) of the optical axis Ax is configured by an inclined surface inclined obliquely upward and rearward from the position of the horizontal plane including the optical axis Ax. A right area 21B of the upward reflective surface 21*a* located on the right side (the left side in the front view of the lamp) of the optical axis Ax is configured by an inclined surface which is lower than the left area by one step via a short inclined surface 21C. The front end edge 21*a*1 of the upward reflective surface 21*a* is formed so as to extend from the position of the rear focal point F toward the left and right sides. Further, the front end edge 21*a*1 of the upward reflective surface 21*a* is formed in a concave shape so that the length in the front-rear direction of the upward reflective surface 21*a* is shortened at the center in the left-right direction.

A lower surface of the upper plate portion 21 on the side opposite to the upper surface constitutes the downward reflective surface 21*b* which reflects a part of light emitted obliquely upward and forward from the light emitting elements 31 toward the projector lens 11 on the front side. The downward reflective surface 21*b* is formed so as to extend rearward and slightly downward from the front end edge 21*a*1 of the upward reflective surface 21*a* to a position near upper portions of the light emitting elements 31 (see FIG. 9).

An upper surface of the lower plate portion 22 constitutes the reflective surface 22*a* which reflects a part of light emitted obliquely downward and forward from the light emitting elements 31 toward the projector lens 11 on the front side. The reflective surface 22*a* is formed so as to extend rearward and slightly upward from an obliquely lower front side of the light emitting elements 31 to a position near lower portions of the light emitting elements 31 (see FIG. 9).

The upward reflective surface 21*a* and the downward reflective surface 21*b* of the upper plate portion 21 and the reflective surface 22*a* of the lower plate portion 22 are minor-finished (hatched portion) by aluminum vapor deposition or the like.

The upper plate portion 21 and the lower plate portion 22 arranged in parallel with a predetermined interval (the opening 23) are supported by mounting portions 24 at both left and right end portions, respectively. A mounting hole 24*a* is formed in each of the mounting portions 24. The optical member 20 is fixed, together with the substrate 32, to the base member 40 by fixing members (e.g., screws) 61 via the mounting holes 24*a* of the mounting portions 24 and mounting holes 32*b* (see FIG. 8) formed in the substrate 32 in a state where the substrate 32 is sandwiched between the optical member 20 and the base member 40.

When the optical member 20 having such a configuration is fixed to the base member 40 (see FIG. 9), each of the light emitting elements 31 mounted on the substrate 32 is arranged such that the light emission surface thereof is exposed from the opening 23 of the optical member 20 obliquely upward (toward the front of the lamp) with respect to the front direction of the lamp. The substrate 32 fixed to the base member 40 together with the optical member 20 is disposed with its upper end portion 32*a* protruding upward from the optical axis Ax of the projector lens 11. Further, the upward reflective surface 21*a* of the upper plate portion 21 is disposed so as to connect the rear focal point F and the upper end portion 32*a* of the substrate 32. The upward reflective surface 25*a* of the reflective member 25 is disposed so as to connect the upper end portion 32*a* of the substrate 32 and a tip end of the rear upper wall portion 40*a*2. In this case, since the stepped portion 42 is provided in the base member 40, a space S is formed between the reflective member 25 and the front upper wall portion 40*a*1. The upper end portion 32*a* of the substrate 32 disposed above the optical axis Ax is accommodated in the space S.

<Modification 1 of Second Embodiment>

Next, a modification 1 of the vehicle lamp 1B described above will be described with reference to FIG. 11. Meanwhile, since the parts having the same reference numerals as those of the second embodiment described above have the same function, a repeated explanation thereof is omitted.

Figure 11A:
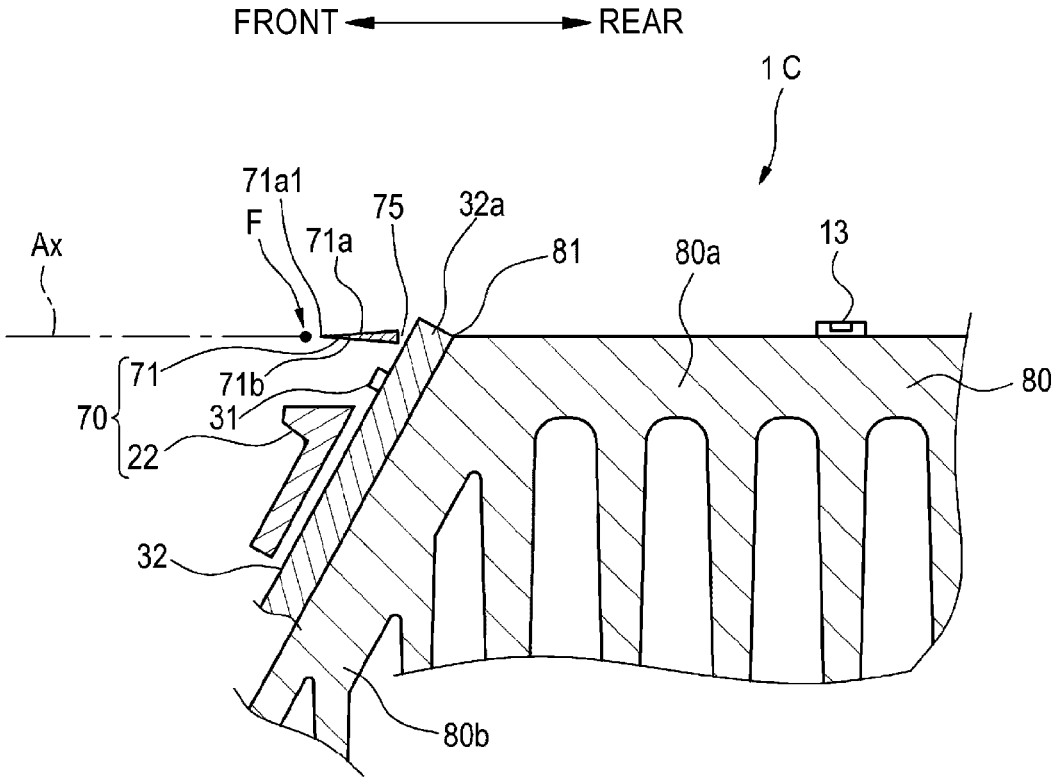
FIG. 11A is a partial sectional view for explaining a vehicle lamp of a modification 1 of the second embodiment.

As shown in FIG. 11, in a vehicle lamp 1C of the modification 1 of the second embodiment, a gap 75 into which the upper end portion 32*a* of the substrate 32 enters is formed between a rear end of an upper plate portion 71 constituting an optical member 70 and a tip end 81 of an upper wall portion 80*a* of a base member 80 in a state where the optical member 70 is fixed to the base member 80. The substrate 32 is fixed to the base member 80 in a state where the upper end portion 32*a* which has entered the gap 75 protrudes from the optical axis Ax.

The upper plate portion 71 of the optical member 70 has a flat plate shape and is formed in the horizontal plane including the optical axis Ax. An upper surface and a lower surface of the upper plate portion 71 are mirror-finished, similar to the upper plate portion 21. An upward reflective surface 71*a*, a downward reflective surface 71*b* and a front end edge 71*a*1 of the upper plate portion 71 are configured to function in the same manner as the respective portions of the upper plate portion 21.

The base member 80 has the upper wall portion 80*a* extending in the horizontal direction and an inclined wall portion 80*b* extending obliquely downward and forward from a front end portion of the upper wall portion 80*a*. The light emitting element 13 is fixed on the upper wall portion 80*a*, and the light emitting elements 31 are fixed on the inclined wall portion 80*b*.

Figure 11B:
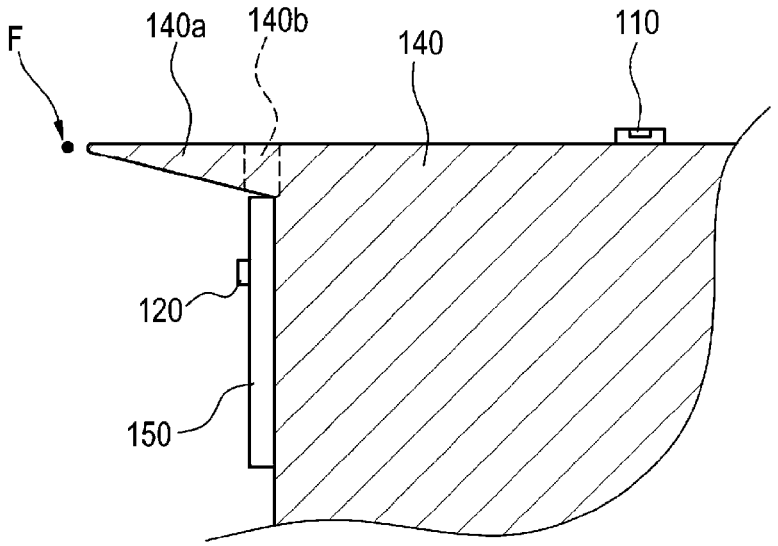
FIG. 11B is a comparative view showing a conventional configuration.

Meanwhile, as shown in FIG. 11B, in the case where a shade 140*a* is integrally formed at a tip end of a base member 140, the shade 140*a* is present above a substrate 150 fixed to the base member 140. Accordingly, there is a physical limitation in bringing light emitting elements 120 mounted on the substrate 150 close to the rear focal point F. In this case, for example, it is possible to bring the light emitting elements 120 close to the rear focal point F by forming a partial opening 140*b* in the shade 140*a* and allowing the substrate 150 to enter the opening 140*b*. However, the processing of such base member 140 is difficult and costly.

On the contrary, according to the configuration of the modification 1 of the second embodiment, the optical member 70 is configured by a member separate from the base member 80, and the gap 75 is provided between a rear end of the upper plate portion 71 and the tip end 81 of the upper wall portion 80*a* when the optical member 70 is fixed to the base member 80. Therefore, the upper end portion 32*a* of the substrate 32 can be arranged above the optical axis Ax through the gap 75, and the degree of freedom in arranging the substrate 32 is improved. As a result, the light emitting elements 31 mounted on the substrate 32 can be arranged near the rear focal point F of the projector lens 11 and the utilization efficiency of the direct light emitted from the light emitting elements 31 can be enhanced, as compared to the conventional configuration shown in FIG. 11B. Further, the upper surface of the upper end portion 32*a* of the substrate 32 may be minor-finished by aluminum vapor deposition or the like and used as the reflective surface.

<Third Embodiment>

Hereinafter, as an example of a vehicle lamp of the disclosure, a vehicle lamp 1D of a third embodiment will be described in detail with reference to the drawings.

Figure 12:
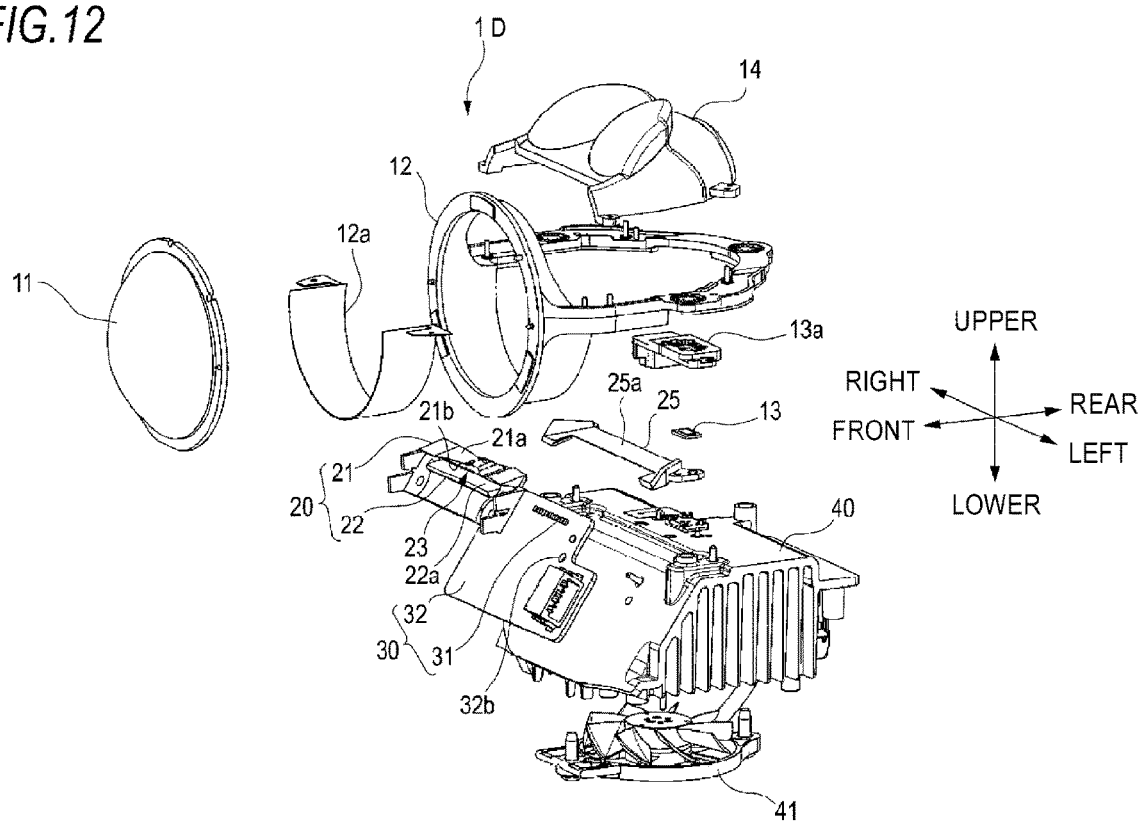
FIG. 12 is an exploded perspective view of a vehicle lamp according to a third embodiment of the disclosure.
Figure 13:
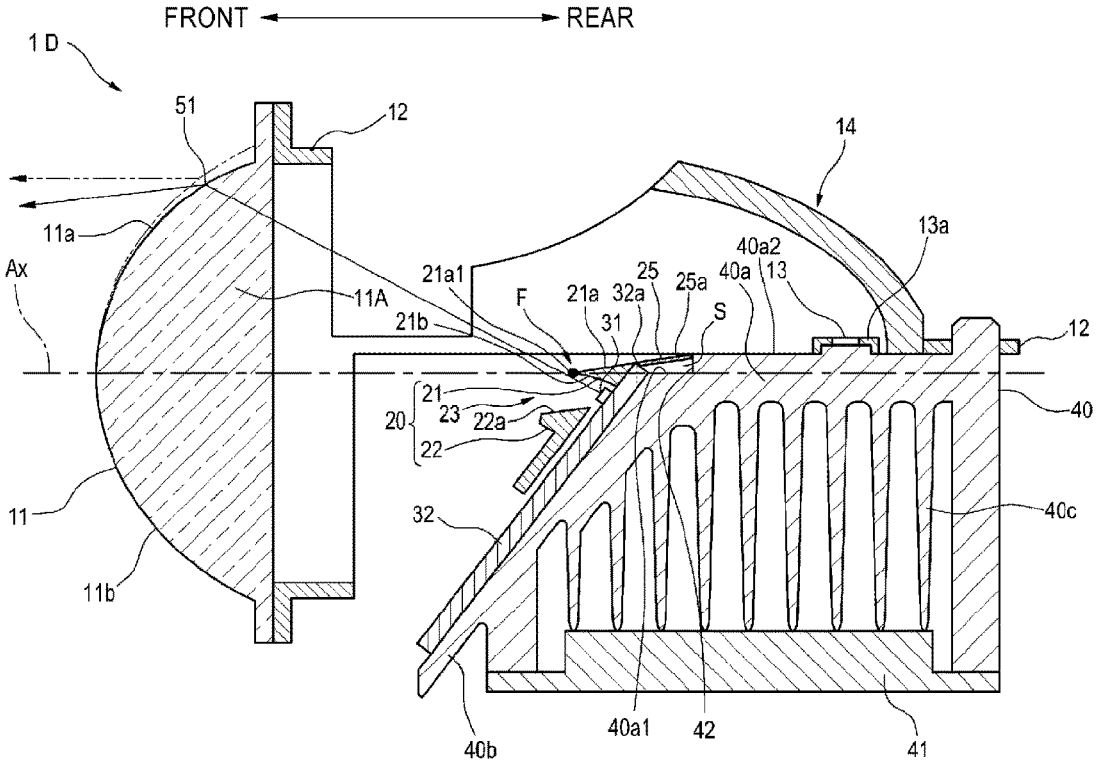
FIG. 13 is a view showing a vertical cross section of the lamp of FIG. 12, as viewed from the horizontal direction.

As shown in FIGS. 12 and 13, the vehicle lamp 1D includes the projector lens 11, the lens holder 12, the light emitting element (an example of a first light source) 13, the reflector 14, the optical member 20, the reflective member 25, the light source unit (an example of a second light source) 30, the base member 40, and the fan 41. Meanwhile, in FIG. 13, for ease of view, the shape of the reflector 14 is shown in a simplified manner.

The vehicle lamp 1D is, for example, a headlamp capable of selectively performing a low-beam irradiation and a high-beam irradiation and is configured as a projector type lamp unit.

The projector lens 11 has the optical axis Ax extending in the front-rear direction of the vehicle. The projector lens 11 is a plano-convex aspheric lens having a front convex surface and a rear flat surface. The projector lens 11 is configured to project a light source image formed on a rear focal plane which is a focal plane including the rear focal point F thereof, as an inverted image, on a virtual vertical screen in front of the lamp. In the present embodiment, the virtual vertical screen is disposed, for example, at a position of 25 m in front of the vehicle. Meanwhile, both the front surface and the rear surface of the projector lens 11 may be convex.

In the projector lens 11 of the present embodiment, the optical path change portion 51 is formed in the upper exit surface 11*a* above the optical axis Ax. The optical path change portion 51 is formed as a curvature processed surface which makes the radius of curvature of the upper exit surface 11*a* smaller than that of the lower exit surface 11*b* below the optical axis Ax. Since the optical path change portion 51 is formed, the light emitted from the light source unit 30 and incident on the upper region 11A of the projector lens 11 is emitted from the upper exit surface 11*a* of the projector lens 11 in a state of being directed slightly downward, as compared with the case where the optical path change portion 51 is not formed (the exit surface indicated by the two-dot chain line in the figure).

The projector lens 11 is fixed to the lens holder 12 at its outer peripheral flange portion. The lens holder 12 for fixing the projector lens 11 is fixed to the base member 40. The extension 12*a* for concealing the inner wall surface of the lens holder 12 so as not to be visible from the outside is attached to the lens holder 12.

The light emitting element 13 is disposed behind the rear focal point F of the projector lens 11. The light emitting element 13 is configured by, for example, a white light emitting diode and has a laterally elongated rectangular light emitting surface. The light emitting element 13 is disposed upward with its light emitting surface positioned slightly above the horizontal plane including the optical axis Ax. The light emitting element 13 is fixed to the base member 40 via the attachment 13*a*. Light emitted from the light emitting element 13 is mainly incident on the region of the rear surface (incident surface) of the projector lens 11 positioned below the optical axis Ax and is emitted from the exit surface, thereby forming a low-beam light distribution pattern. Meanwhile, in the present embodiment, the "low-beam light distribution pattern" and the "additional high-beam light distribution pattern" (to be described later) mean light distribution patterns formed on a virtual vertical screen disposed, for example, at a position of 25 m in front of the vehicle.

The reflector 14 is disposed so as to cover the light emitting element 13 from the upper side and configured to reflect light from the light emitting element 13 toward the projector lens 11. The reflective surface of the reflector 14 for reflecting light has an axis connecting the rear focal point F and the light emission center of the light emitting element 13. The reflective surface is formed by a substantially elliptical curved surface having the light emission center of the light emitting element 13 as a first focal point. The reflective surface is set such that its eccentricity gradually increases from a vertical cross section toward a horizontal cross section. The reflector 14 is fixed to the lens holder 12.

The light source unit 30 includes the plurality of light emitting elements 31 and the substrate 32.

The light emitting elements 31 are mounted on the substrate 32 and arranged in the left-right direction at the lower rear side of the rear focal point F of the projector lens 11. Each of the light emitting elements 31 is configured by, for example, a white light emitting diode and has a square light emission surface (an example of the emission portion), for example.

In the present embodiment, eleven light emitting elements 31 are arranged on the substrate 32. For example, the light emitting elements 31 are arranged at equal intervals in the left-right direction and centered on the position directly below the optical axis Ax. Each of the light emitting elements 31 can be individually tuned on by a lighting control circuit provided on the substrate 32. Light emitted from the light emitting elements 31 is incident on substantially the entire area of the incident surface of the projector lens 11 and emitted from the exit surface, thereby forming an additional high-beam light distribution pattern. The light of each light emitting element 31 directed toward the projector lens 11 passes through its rear focal plane with a certain extent. The range of the bundle of light beams slightly overlaps between adjacent light emitting elements. Meanwhile, the light emitting elements 31 may not be arranged in a bilaterally symmetrical manner with respect to the position directly below the optical axis Ax. Further, the light emitting elements 31 may not be arranged at equal intervals.

The optical member 20 has the plate-shaped upper plate portion 21 and the plate-shaped lower plate portion 22 arranged in parallel in a substantially horizontal manner with a predetermined interval in the upper-lower direction. A spaced interval between the upper plate portion 21 and the lower plate portion 22 serves as the opening 23 through which the light emitted from the light emitting elements 31 passes. The optical member 20 is formed of aluminum die cast or transparent polycarbonate resin or the like having excellent heat resistance.

An upper surface of the upper plate portion 21 constitutes a shade for shielding a part of light emitted from the light emitting element 13 and reflected by the reflector 14 and constitutes the upward reflective surface 21*a* for reflecting the shielded light toward the projector lens 11. The upward reflective surface 21*a* is formed so as to be inclined slightly forward and downward with respect to the horizontal plane including the optical axis Ax.

A left area of the upward reflective surface 21*a* located on the left side (the right side in the front view of the lamp) of the optical axis Ax is configured by an inclined surface inclined obliquely upward and rearward from the position of the horizontal plane including the optical axis Ax. A right area of the upward reflective surface 21*a* located on the right side (the right side in the front view of the lamp) of the optical axis Ax is configured by an inclined surface which is lower than the left area by one step via a short inclined surface. The front end edge 21*a*1 of the upward reflective surface 21*a* is formed so as to extend from the position of the rear focal point F toward the left and right sides.

A lower surface of the upper plate portion 21 on the side opposite to the upper surface constitutes the downward reflective surface 21*b* which reflects a part of light emitted obliquely upward and forward from the light emitting elements 31 toward the projector lens 11 on the front side. The downward reflective surface 21*b* is formed so as to extend rearward and slightly downward from the front end edge 21*a*1 of the upward reflective surface 21*a* to a position near upper portions of the light emitting elements 31.

An upper surface of the lower plate portion 22 constitutes the reflective surface 22*a* which reflects a part of light emitted obliquely downward and forward from the light emitting elements 31 toward the projector lens 11 on the front side. The reflective surface 22*a* is formed so as to extend rearward and slightly upward from an obliquely lower front side of the light emitting elements 31 to a position near lower portions of the light emitting elements 31.

The upward reflective surface 21*a* and the downward reflective surface 21*b* of the upper plate portion 21 and the reflective surface 22*a* of the lower plate portion 22 are mirror-finished by aluminum vapor deposition or the like.

The optical member 20 is provided as a single independent member and is fixed, together with the substrate 32, to the base member 40 in a state where the substrate 32 is interposed between the optical member 20 and the base member 40. In a state where the optical member 20 is fixed to the base member 40, each of the light emitting elements 31 mounted on the substrate 32 is arranged such that the light emission surface 31*a* is exposed from the opening 23 of the optical member 20 obliquely upward (toward the front of the lamp) with respect to the front direction of the lamp. The upper end portion 32*a* of the substrate 32 fixed to the base member 40 is arranged so as to protrude upward beyond the optical axis Ax of the projector lens 11.

The reflective member 25 is formed in a flat plate shape and disposed behind the upper plate portion 21 so as to be continuous with the upper plate portion 21. The upper surface of the reflective member 25 constitutes the upward reflective surface 25*a* which shields a part of light emitted from the light emitting element 13 and reflected by the reflector 14 and then reflects the shielded light toward the projector lens 11. The upward reflective surface 25*a* is mirror-finished by aluminum vapor deposition or the like. The reflective member 25 is provided so as to be inclined slightly forward and downward with respect to the horizontal plane including the optical axis Ax. Further, the reflective member 25 is disposed so as to cover the upper end portion 32*a* of the substrate 32 from above and is fixed to the base member 40.

The base member 40 has the upper wall portion 40*a* extending in the horizontal direction and the inclined wall portion 40*b* extending obliquely downward and forward from a front end of the upper wall portion 40*a*. The stepped portion 42 is formed on the upper wall portion 40*a*. A lower portion of the upper wall portion 40*a* on the front side of the stepped portion 42 is defined as the front upper wall portion 40*a*1, and a higher portion thereof on the rear side of the stepped portion 42 is defined as the rear upper wall portion 40*a*2. The reflective member 25 is fixed on an upper surface of the front upper wall portion 40*a*1, and the light emitting element 13 is fixed on an upper surface of the rear upper wall portion 40*a*2. Further, the optical member 20 and the substrate 32 on which the light emitting elements 31 are mounted are fixed to an upper surface of the inclined wall portion 40*b*. The light emitting elements 31 on the upper surface of the inclined wall portion 40*b* are fixed such that the light emission surfaces 31*a* face obliquely forward and upward due to the inclination of the inclined wall portion 40*b* and are disposed on the lower rear side of the rear focal point F of the projector lens 11.

A plurality of heat-radiation fins 40*c* extending in the upper-lower direction and the left-right direction is arranged side by side in the front-rear direction on the lower surface of the upper wall portion 40*a* and the lower surface of the inclined wall portion 40*b*. The base member 40 is arranged such that the position of the upper surface of the front upper wall portion 40*a*1 is defined as the position of the horizontal plane including the optical axis Ax.

In a state where the optical member 20 is fixed to the base member 40, the upward reflective surface 21*a* of the upper plate portion 21 is disposed so as to connect the rear focal point F and the upper end portion 32*a* of the substrate 32. Further, the upward reflective surface 25*a* of the reflective member 25 is disposed so as to connect the upper end portion 32*a* of the substrate 32 and a tip end of the rear upper wall portion 40*a*2. In this case, since the stepped portion 42 is provided in the base member 40, the space S is formed between the reflective member 25 and the front upper wall portion 40*a*1. The upper end portion 32*a* of the substrate 32 disposed above the optical axis Ax is accommodated in the space S.

The fan 41 is disposed below the base member 40. The wind generated from the fan 41 is sent to the heat-radiation fins 40*c* extending downward from the lower side.

Meanwhile, in a state where the adjustment of the optical axis is completed, the vehicle lamp 1D is configured so that the optical axis Ax is provided slightly downward with respect to the front-rear direction of the vehicle, for example.

<Fourth Embodiment>

Hereinafter, as an example of a vehicle lamp and a substrate of the disclosure, a vehicle lamp 1001 and a substrate of a fourth embodiment will be described in detail with reference to the drawings.

Figure 14:
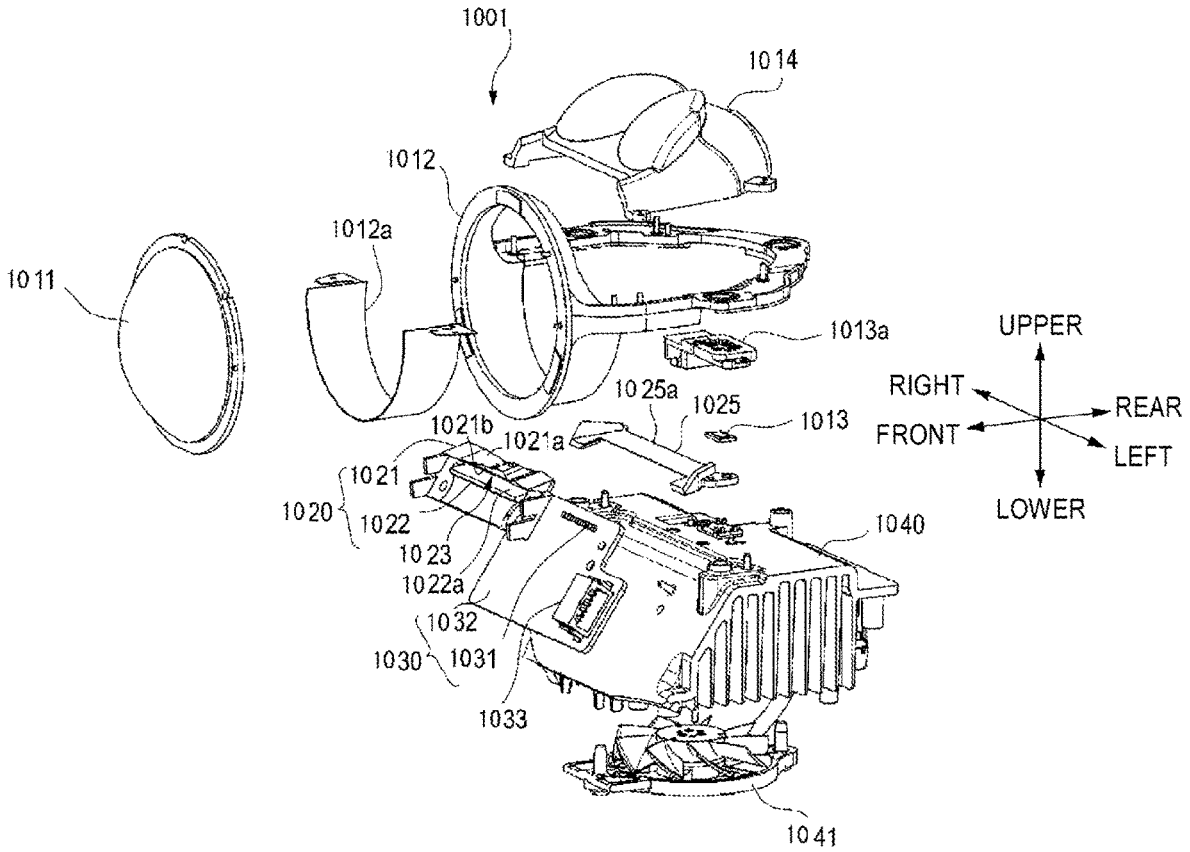
FIG. 14 is an exploded perspective view of a vehicle lamp according to a fourth embodiment of the disclosure.
Figure 15:
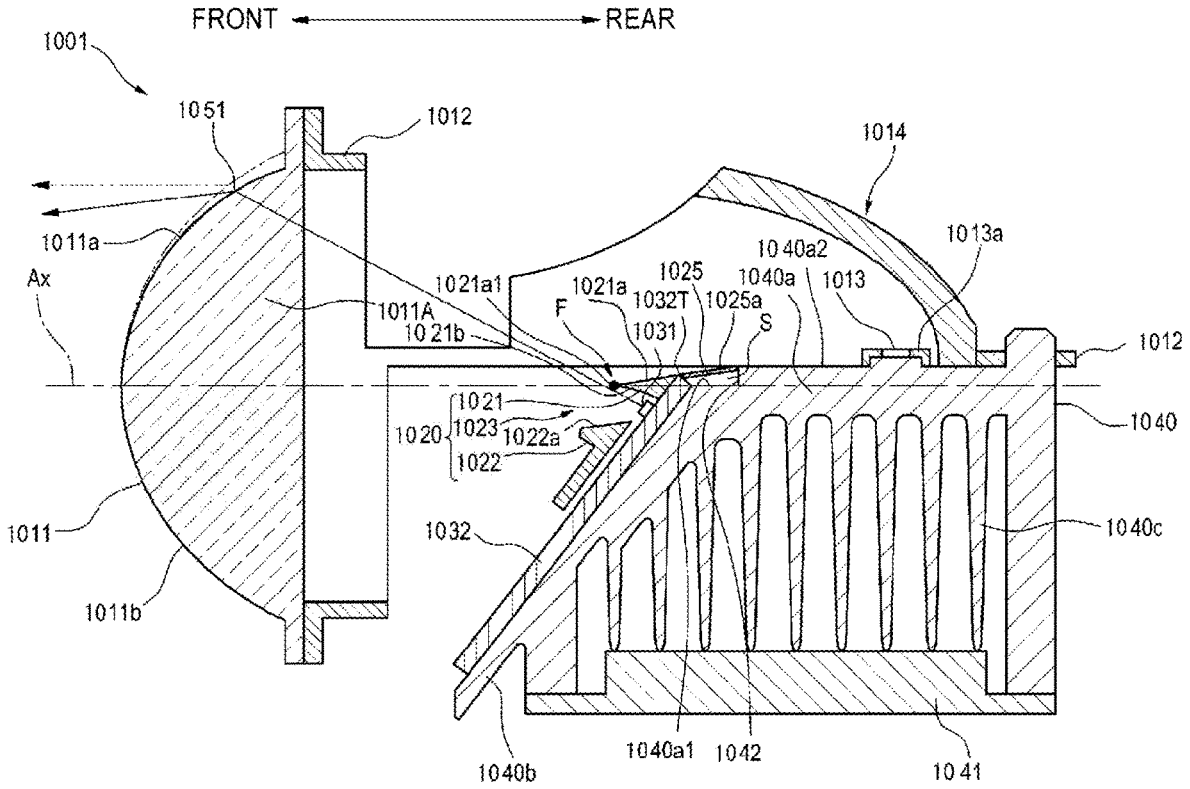
FIG. 15 is a view showing a vertical cross section of the lamp of FIG. 14, as viewed from the horizontal direction.

As shown in FIGS. 14 and 15, the vehicle lamp 1001 includes a projector lens 1011, a lens holder 1012, a light emitting element 1013, a reflector 1014, an optical member 1020, a reflective member 1025, a light source unit (an example of a light source) 1030, a base member 1040, and a fan 1041. Meanwhile, in FIG. 15, for ease of view, the shape of the reflector 1014 is shown in a simplified manner.

Similar to the first and third embodiments, the vehicle lamp 1001 is, for example, a headlamp capable of selectively performing a low-beam irradiation and a high-beam irradiation and is configured as a projector type lamp unit.

The projector lens 1011 has the optical axis Ax extending in the front-rear direction of the vehicle. The projector lens 1011 is a plano-convex aspheric lens having a front convex surface and a rear flat surface. The projector lens 1011 is configured to project a light source image formed on a rear focal plane which is a focal plane including the rear focal point F thereof, as an inverted image, on a virtual vertical screen in front of the lamp. Meanwhile, in the present embodiment, the virtual vertical screen is disposed, for example, at a position of 25 m in front of the vehicle. Further, both the front surface and the rear surface of the projector lens 1011 may be convex.

In the projector lens 1011 of the present embodiment, an optical path change portion 1051 is formed in an upper exit surface 1011*a* above the optical axis Ax. For example, the optical path change portion 1051 can be formed as a curvature processed surface which makes the radius of curvature of the upper exit surface 1011*a* smaller than that of a lower exit surface 1011*b* below the optical axis Ax. Since the optical path change portion 1051 is formed, the light emitted from the light source unit 1030 and incident on the upper region 1011A of the projector lens 1011 is emitted from the upper exit surface 1011*a* of the projector lens 1011 in a state of being directed slightly downward, as compared with the case where the optical path change portion 1051 is not formed (the exit surface indicated by the two-dot chain line in FIG. 1).

The projector lens 1011 is fixed to the lens holder 1012 at its outer peripheral flange portion. The lens holder 1012 for fixing the projector lens 1011 is fixed to the base member 1040. An extension 1012*a* for concealing an inner wall surface of the lens holder 1012 so as not to be visible from the outside is attached to the lens holder 1012.

The light emitting element 1013 is disposed behind the rear focal point F of the projector lens 1011. The light emitting element 1013 is configured by, for example, a white light emitting diode and has a laterally elongated rectangular light emitting surface. The light emitting element 1013 is disposed upward with its light emitting surface positioned slightly above the horizontal plane including the optical axis Ax. The light emitting element 1013 is fixed to the base member 1040 via an attachment 1013*a*. Light emitted from the light emitting element 1013 is mainly incident on the region of the rear surface (incident surface) of the projector lens 1011 positioned below the optical axis Ax and is emitted from the exit surface, thereby forming a low-beam light distribution pattern. Meanwhile, in the fourth embodiment, similar to the first to third embodiments, the "low-beam light distribution pattern" and the "additional high-beam light distribution pattern" (to be described later) mean light distribution patterns formed on a virtual vertical screen disposed, for example, at a position of 25 m in front of the vehicle.

The reflector 1014 is disposed so as to cover the light emitting element 1013 from the upper side and configured to reflect light from the light emitting element 1013 toward the projector lens 1011. The reflective surface of the reflector 1014 for reflecting light has an axis connecting the rear focal point F and the light emission center of the light emitting element 1013. The reflective surface is formed by a substantially elliptical curved surface having the light emission center of the light emitting element 1013 as a first focal point. The reflective surface is set such that its eccentricity gradually increases from a vertical cross section toward a horizontal cross section. The reflector 1014 is fixed to the lens holder 1012.

The light source unit 1030 includes a plurality of light emitting elements 1031 and a substrate 1032 made of a metal (e.g., copper).

The light emitting elements 1031 are mounted on the substrate 1032 and arranged in the left-right direction at the lower rear side of the rear focal point F of the projector lens 1011. Each of the light emitting elements 1031 is configured by, for example, a white light emitting diode and has a square light emission surface, for example.

In the present embodiment, eleven light emitting elements 1031 are arranged on the substrate 1032. For example, the light emitting elements 1031 are arranged at equal intervals in the left-right direction and centered on the position directly below the optical axis Ax. Each of the light emitting elements 1031 is connected to a power supply terminal (e.g., a connector or the like) 1033 via a wiring pattern formed on the substrate 1032 and can be individually tuned on under the control of a lighting control circuit (not shown). The power supply terminal 1033 is disposed at a position where it does not interfere with optical paths of the light emitting elements 1031. Light emitted from the light emitting elements 1031 is incident on substantially the entire area of the incident surface of the projector lens 1011 and emitted from the exit surface, thereby forming an additional high-beam light distribution pattern. The light of each light emitting element 1031 directed toward the projector lens 1011 passes through its rear focal plane with a certain extent. The range of the bundle of light beams slightly overlaps between adjacent light emitting elements. Meanwhile, the light emitting elements 1031 may not be arranged in a bilaterally symmetrical manner with respect to the position directly below the optical axis Ax. Further, the light emitting elements 1031 may not be arranged at equal intervals.

The optical member 1020 is disposed behind the projector lens 1011 and has a plate-shaped upper plate portion 1021 and a plate-shaped lower plate portion 1022 arranged in parallel in a substantially horizontal manner with a predetermined interval in the upper-lower direction. A spaced interval between the upper plate portion 1021 and the lower plate portion 1022 serves as an opening 1023 through which the light emitted from the light emitting elements 1031 passes. The optical member 1020 is formed of aluminum die cast or transparent polycarbonate resin or the like having excellent heat resistance.

An upper surface of the upper plate portion 1021 constitutes an upward reflective surface 1021*a* which shields a part of light emitted from the light emitting element 1013 and reflected by the reflector 1014 and reflects the shielded light toward the projector lens 1011. The upper reflective surface 1021*a* functions as a shade and also functions as a reflector. The upward reflective surface 1021*a* is formed so as to be inclined slightly forward and downward with respect to the horizontal plane including the optical axis Ax.

A left area of the upward reflective surface 1021*a* located on the left side (the right side in the front view of the lamp) of the optical axis Ax is configured by an inclined surface inclined obliquely upward and rearward from the position of the horizontal plane including the optical axis Ax. A right area of the upward reflective surface 1021*a* located on the right side (the left side in the front view of the lamp) of the optical axis Ax is configured by an inclined surface which is lower than the left area by one step via a short inclined surface. A front end edge 1021*a*1 of the upward reflective surface 1021*a* is formed so as to extend from the position of the rear focal point F toward the left and right sides.

A lower surface of the upper plate portion 1021 on the side opposite to the upper surface constitutes a downward reflective surface 1021*b* which reflects a part of light emitted obliquely upward and forward from the light emitting elements 1031 toward the projector lens 1011 on the front side. The downward reflective surface 1021*b* is formed so as to extend rearward and slightly downward from the front end edge 1021*a*1 of the upward reflective surface 1021*a* to a position near upper portions of the light emitting elements 1031.

An upper surface of the lower plate portion 1022 constitutes a reflective surface 1022*a* which reflects a part of light emitted obliquely downward and forward from the light emitting elements 1031 toward the projector lens 1011 on the front side. The reflective surface 1022*a* is formed so as to extend rearward and slightly upward from an obliquely lower front side of the light emitting elements 1031 to a position near lower portions of the light emitting elements 1031.

The upward reflective surface 1021*a* and the downward reflective surface 1021*b* of the upper plate portion 1021 and the reflective surface 1022*a* of the lower plate portion 1022 are mirror-finished by aluminum vapor deposition or the like.

The optical member 1020 is fixed, together with the substrate 1032, to the base member 1040 in a state where the substrate 1032 is interposed between the optical member 1020 and the base member 1040. In a state where the optical member 1020 is fixed to the base member 1040, each of the light emitting elements 1031 mounted on the substrate 1032 is arranged such that its light emission surface is exposed from the opening 1023 of the optical member 1020 obliquely upward (toward the front of the lamp) with respect to the front direction of the lamp. An upper end portion 1032T of the substrate 1032 fixed to the base member 1040 is arranged so as to protrude upward beyond the optical axis Ax of the projector lens 1011.

The reflective member 1025 is formed in a flat plate shape and disposed behind the upper plate portion 1021 so as to be continuous with the upper plate portion 1021. The upper surface of the reflective member 1025 constitutes an upward reflective surface 1025*a* which shields a part of light emitted from the light emitting element 1013 and reflected by the reflector 1014 and then reflects the shielded light toward the projector lens 1011. The upward reflective surface 1025*a* is mirror-finished by aluminum vapor deposition or the like. The reflective member 1025 is provided so as to be inclined slightly forward and downward with respect to the horizontal plane including the optical axis Ax. Further, the reflective member 1025 is disposed so as to cover the upper end portion 1032T of the substrate 1032 from above and is fixed to the base member 1040.

The base member 1040 is formed of a metal (e.g., iron, aluminum, copper, or the like) and has an upper wall portion 1040*a* extending in the horizontal direction and an inclined wall portion 1040*b* extending obliquely downward and forward from a front end of the upper wall portion 1040*a*. A stepped portion 1042 is formed on the upper wall portion 1040*a*. A lower portion of the upper wall portion 1040*a* on the front side of the stepped portion 1042 is defined as a front upper wall portion 1040*a*1, and a higher portion thereof on the rear side of the stepped portion 1042 is defined as a rear upper wall portion 1040*a*2. The reflective member 1025 is fixed on an upper surface of the front upper wall portion 1040*a*1, and the light emitting element 1013 is fixed on an upper surface of the rear upper wall portion 1040*a*2. Further, the optical member 1020 and the substrate 1032 on which the light emitting elements 1031 are mounted are fixed to an upper surface of the inclined wall portion 1040*b*.

A plurality of heat-radiation fins 1040*c* extending in the upper-lower direction and the left-right direction is arranged side by side in the front-rear direction on the lower surface of the upper wall portion 1040*a* and the lower surface of the inclined wall portion 1040*b*. The base member 1040 is arranged such that the position of the upper surface of the front upper wall portion 1040*a*1 is defined as the position of the horizontal plane including the optical axis Ax.

In a state where the optical member 1020 is fixed to the base member 1040, the upward reflective surface 1021*a* of the upper plate portion 1021 is disposed so as to connect the rear focal point F and the upper end portion 1032T of the substrate 1032. Further, the upward reflective surface 1025*a* of the reflective member 1025 is disposed so as to connect the upper end portion 1032T of the substrate 1032 and a tip end of the rear upper wall portion 1040*a*2. In this case, since the stepped portion 1042 is provided in the base member 1040, the space S is formed between the reflective member 1025 and the front upper wall portion 1040*a*1. The upper end portion 1032T of the substrate 1032 disposed above the optical axis Ax is accommodated in the space S.

The fan 1041 is disposed below the base member 1040. The wind generated from the fan 1041 is sent to the heat-radiation fins 1040*c* extending downward from the lower side.

Meanwhile, in a state where the adjustment of the optical axis is completed, the vehicle lamp 1001 is configured so that the optical axis Ax is provided slightly downward with respect to the front-rear direction of the vehicle, for example.

Figure 16:
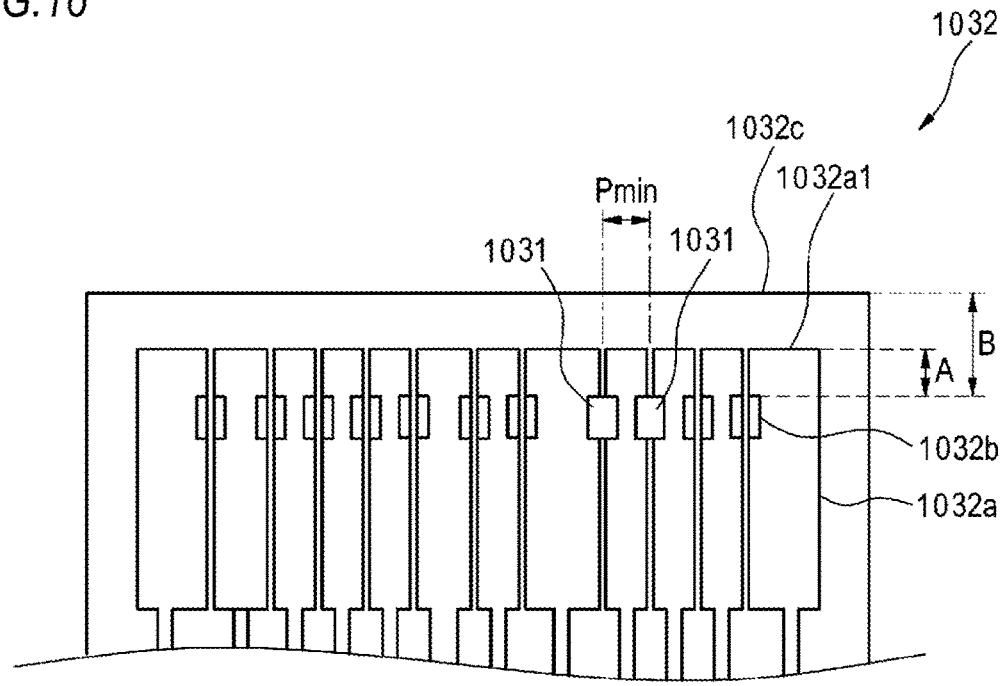
FIG. 16 is a view for explaining a substrate used for the vehicle lamp according to the fourth embodiment.

In the vehicle lamp 1001 having such a configuration, as shown in FIG. 16, the substrate 1032 of the present embodiment is configured such that a plurality of wiring patterns (copper foil patterns) 1032*a* and mounting portions (solder lands) 1032*b* provided on each of the wiring patterns 1032*a* are formed on the substrate 1032. Electrodes of the light emitting elements 1031 are solder-connected between the mounting portions 1032*b* of the adjacent wiring patterns 1032*a*. Meanwhile, FIG. 16 shows a state in which two light emitting elements 1031 are mounted.

As shown in FIG. 16, the substrate 1032 is formed so as to meet the following conditions (1) and (2) when a shortest distance between the mounting portions 1032*b* and end portions 1032*a*1 of the wiring patterns 1032*a* is defined as A, a shortest distance between the mounting portions 1032*b* and an end portion 1032*c* of the substrate 1032 is defined as B, and a minimum arrangement pitch between the mounted light emitting elements 1031 is defined as Pmin.

(1) The ratio (A/Pmin) of the shortest distance A to the minimum arrangement pitch Pmin is 0.57 or more (A/Pmin≥0.57).

(2) The ratio (B/Pmin) of the shortest distance B to the minimum arrangement pitch Pmin is 1.7 or more (B/Pmin≥1.7).

Figure 17:
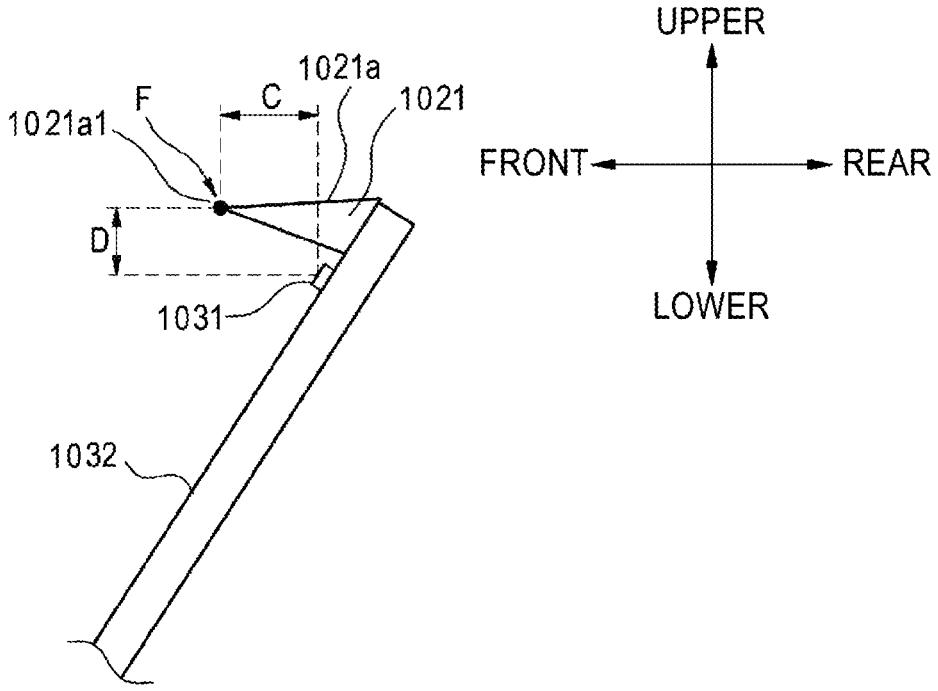
FIG. 17 is a view for explaining a fixed position of a light emitting element.

Further, as shown in FIG. 17, each light emitting element 1031 of the present embodiment in the vehicle lamp 1001 is disposed at such a position that a distance C from the front end edge 1021*a*1 of the upward reflective surface 1021*a* of the upper plate portion 1021 toward the rear side of the lamp in the front-rear direction of the vehicle lamp 1001 is less than 5 mm (C<5 mm). Furthermore, each light emitting element 1031 is disposed at such a position that a distance D from the front end edge 1021*a*1 toward the lower side of the lamp in the upper-lower direction of the vehicle lamp 1D is less than 4 mm (D<4 mm).

EXAMPLES

The operating temperature of the light emitting elements 1031 mounted on the substrate 1032 will be described below with reference to examples.

Figure 18A:
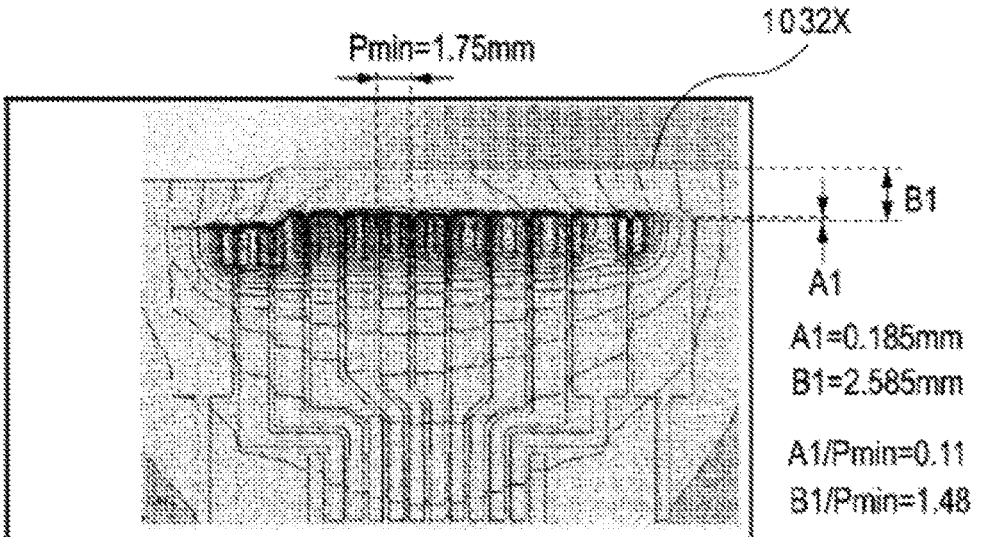
FIGS. 18A to 18C are views showing temperature measurement results of the light emitting element.
Figure 18B:
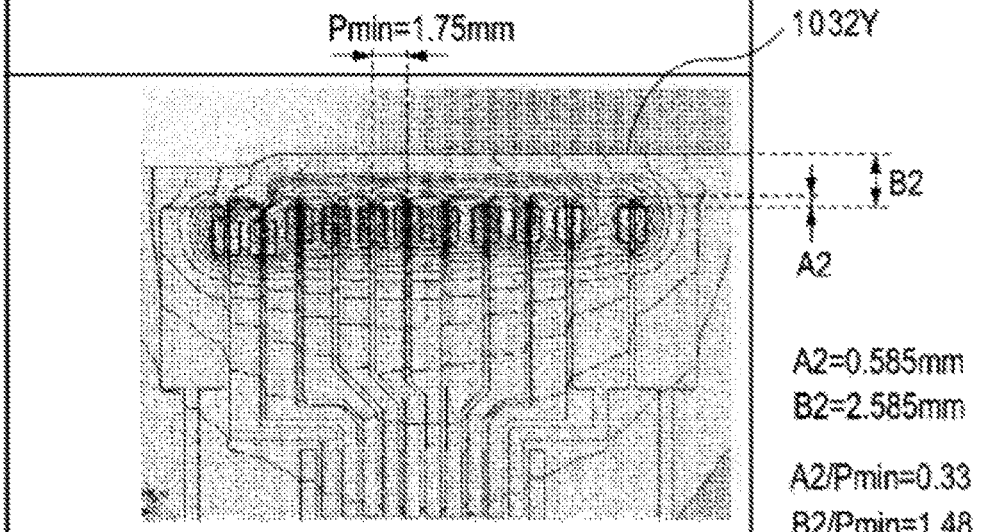
Figure 18C:
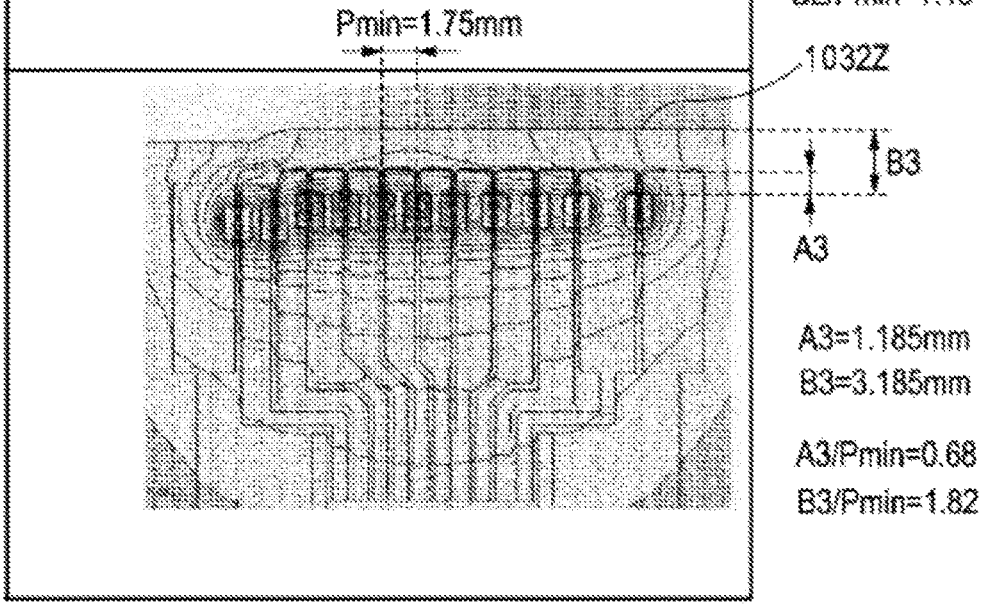

In the vehicle lamp 1001 according to the above embodiment, the temperature rise of the light emitting elements 1031 mounted on the substrate 1032 when the substrate 1032 having the specifications configured as shown in FIGS. 18A to 18C was mounted and high-beam irradiation was performed was measured. Meanwhile, the minimum arrangement pitch (Pmin) between the light emitting elements 1031 is assumed to be 1.75 mm (Pmin=1.75 mm). Further, a copper substrate was used for the substrate 1032. For the temperature, the surface temperature of the light emitting elements 1031 and the substrate 1032 was measured using a thermography.

Reference Example 1

FIG. 18A shows the temperature distribution on a substrate 1032X according to a reference example 1 as a thermal image. In the substrate 1032X according to the reference example 1, a shortest distance (A1) between the mounting portions 1032*b* and the end portions 1032*a*1 of the wiring patterns 1032*a* was set to 0.185 mm (A1=0.185 mm), and a shortest distance (B1) between the mounting portions 1032*b* and the end portion 1032*c* of the substrate 1032X was set to 2.585 mm (B1=2.585 mm). In this case, the ratio (A1/Pmin) of the shortest distance A1 to the minimum arrangement pitch Pmin was 0.11 (A1/Pmin=0.11), and the ratio (B1/Pmin) of the shortest distance B1 to the minimum arrangement pitch Pmin was 1.48 (B1/Pmin=1.48).

As a result of temperature measurement, as shown in FIG. 18A, in many of the light emitting elements 1031, the temperature was risen to 70° C. or more and it was not possible to operate the light emitting elements at temperatures below the product condition.

Reference Example 2

FIG. 18B shows the temperature distribution on a substrate 1032Y according to a reference example 2 as a thermal image. In the reference example 2, with respect to the set distances of the reference example 1, a shortest distance B2 and the shortest distance B1 are the same, and only the size of a shortest distance A2 was increased by 0.4 mm. That is, by forming the end portions 1032*a*1 of the wiring patterns 1032*a* close to the end portion 1032*c* of the substrate 1032Y by 0.4 mm, the distance between the mounting portions 1032*b* and the end portions 1032*a*1 of the wiring patterns 1032*a* was increased by 0.4 mm, A2=0.585 mm, and B2=2.585 mm. In this case, the ratio (A2/Pmin) of A2 to Pmin is equal to 0.33 (A2/Pmin=0.33), and the ratio (B2/Pmin) of B2 to Pmin is equal to 1.48 (B2/Pmin=1.48).

As a result of temperature measurement, with respect to the measurement results of the reference example 1, the temperature reduction effect was −1.4° C.

However, as shown in FIG. 18B, the temperature of the light emitting elements 1031 was risen to 70° C. or more at some locations and it cannot be said that it is possible to operate the light emitting elements at temperatures below the product condition.

Example 1

FIG. 18C shows the temperature distribution on a substrate 1032Z according to an example 1 as a thermal image. In the example 1, with respect to the set distances of the reference example 1, the size of a shortest distance A3 was increased by 1.0 mm, and the size of a shortest distance B3 was increased by 0.6 mm. That is, the mounting portions 1032*b* were formed away from the end portion 1032*c* of the substrate 1032Z and the end portions 1032*a*1 of the wiring patterns 1032*a*, A3=1.185 mm, and B3=3.185 mm. In this case, the ratio (A3/Pmin) of A3 to Pmin is equal to 0.68 (A3/Pmin=0.68), and the ratio (B3/Pmin) of B3 to Pmin is equal to 1.82 (B3/Pmin=1.82).

As a result of temperature measurement, with respect to the measurement results of the reference example 1, the temperature reduction effect was −2.7° C. Further, as shown in FIG. 18C, the temperature of the light emitting elements 1031 could be suppressed to 70° C. or less.

From the results of the example 1, it was confirmed that the light emitting elements 1031 can be operated at a temperature equal to or lower than the product condition by using the substrate 1032Z.

(Others)

Further, as a result of testing based on the above results, it was confirmed that the light emitting elements 1031 can be operated at a temperature equal to or lower than the product condition when the following conditions are satisfied.

(1) The ratio (A/Pmin) of the shortest distance A to the minimum arrangement pitch Pmin is 0.57 or more (A/Pmin≥0.57).

(2) The ratio (B/Pmin) of the shortest distance B to the minimum arrangement pitch Pmin is 1.7 or more (B/Pmin≥1.7).

Meanwhile, in a configuration in which a low-beam irradiation and a high-beam irradiation can be selectively performed by a projector type optical system using a single projector lens, in order to obtain a good light distribution pattern, it is necessary to arrange a light source (high-beam light source) for forming an additional high-beam light distribution pattern as close as possible to the optical axis of the projector lens. In many cases, a surface mounting type light emitting diode (Light Emitting Diode) is adopted as the high-beam light source. At this time, heat radiation is improved by mounting the light emitting diode on a metal substrate having high thermal conductivity. However, when the LED is brought closer to the optical axis, the LED should be arranged on the end side of the metal substrate. Therefore, heat radiation performance is degraded, and the temperature of the LED rises.

On the contrary, according to the vehicle lamp 1001 of the present embodiment, the ratio (A/Pmin) of the shortest distance A from the mounting portions 1032*b* to the end portions 1032*a*1 of the wiring patterns 1032*a* to the minimum arrangement pitch Pmin of the light emitting elements 1031 mounted on the substrate 1032 is set to 0.57 or more, and the ratio (B/Pmin) of the shortest distance B from the mounting portions 1032*b* to the end portion 1032*c* of the substrate 1032 to the minimum arrangement pitch Pmin is set to 1.7 or more. As a result, as described in the above example 1, the light emitting elements 1031 are prevented from being heated to, for example, a temperature equal to or higher than the product condition even when the light source unit 1030 is operated for a certain time or more under the high-beam irradiation. That is, it is possible to arrange the light emitting elements 1031 as close as possible above the optical axis Ax while sufficiently securing a heat radiation area of the substrate 1032 in order to reduce the temperature rise of the light emitting elements 1031. In this manner, it is possible to reduce a decrease in the product life of the vehicle lamp 1001.

Further, the substrate 1032 on which the light emitting elements 1031 are mounted is fixed to the base member 1040 formed of aluminum or the like. Therefore, heat generated from the light emitting elements 1031 can be radiated from the base member 1040 via the substrate 1032, and the light emitting elements 1031 are further prevented from being heated to a temperature equal to or higher than the product condition.

Further, in the vehicle lamp 1001, the upper plate portion 1021 and the lower plate portion 1022 are provided on the upper and lower sides in front of the light emitting elements 1031 in order to allow light emitted from the light emitting elements 1031 to be efficiently incident on the projector lens 1011. Furthermore, in order to obtain a good light distribution by increasing the maximum (Max) luminosity of light emitted from the projector lens 1011, the substrate 1032 on which the light emitting elements 1031 are mounted is inclined, the amount of light incident on the upper plate portion 1021 and the lower plate portion 1022 is increased, and light is controlled (collected) with the upper plate portion 1021 and the lower plate portion 1022. In this case, when the light emitting elements 1031 are spaced, in the front-direction of the lamp, away from the front end edge 1021*a*1 of the upper plate portion 1021, the maximum luminosity is lowered. Further, when the light emitting elements 1031 are too close, in the front-rear direction of the lamp, to the front end edge 1021*a*1, unevenness occurs in light distribution. On the other hand, when the positions of the light emitting element 1031 are raised, in the upper-lower direction of the lamp, too much upward, it is difficult to form the upper plate portion 1021. Further, when the positions of the light emitting element 1031 are lowered, in the upper-lower direction of the lamp, too much downward, a bright light distribution portion due to direct light appears above and away from a cut line. Therefore, in consideration of these points, in the vehicle lamp 1001, the light emitting elements 1031 are disposed at such a position (see FIG. 17) that the distance from the front end edge 1021*a*1 to the light emitting elements 1031, that is, C is less than 5 mm and D is less than 4 mm (C<5 mm and D<4 mm). In this way, occurrence of unevenness can be reduced while securing brightness, and the excellent additional high-beam light distribution pattern PA can be obtained.

Next, a modification of a shade member in the above-described embodiment will be described with reference to FIG. 19. Meanwhile, since the parts having the same reference numerals as those of the above-described fourth embodiment described above have the same function, a repeated explanation thereof is omitted.

Figure 19:
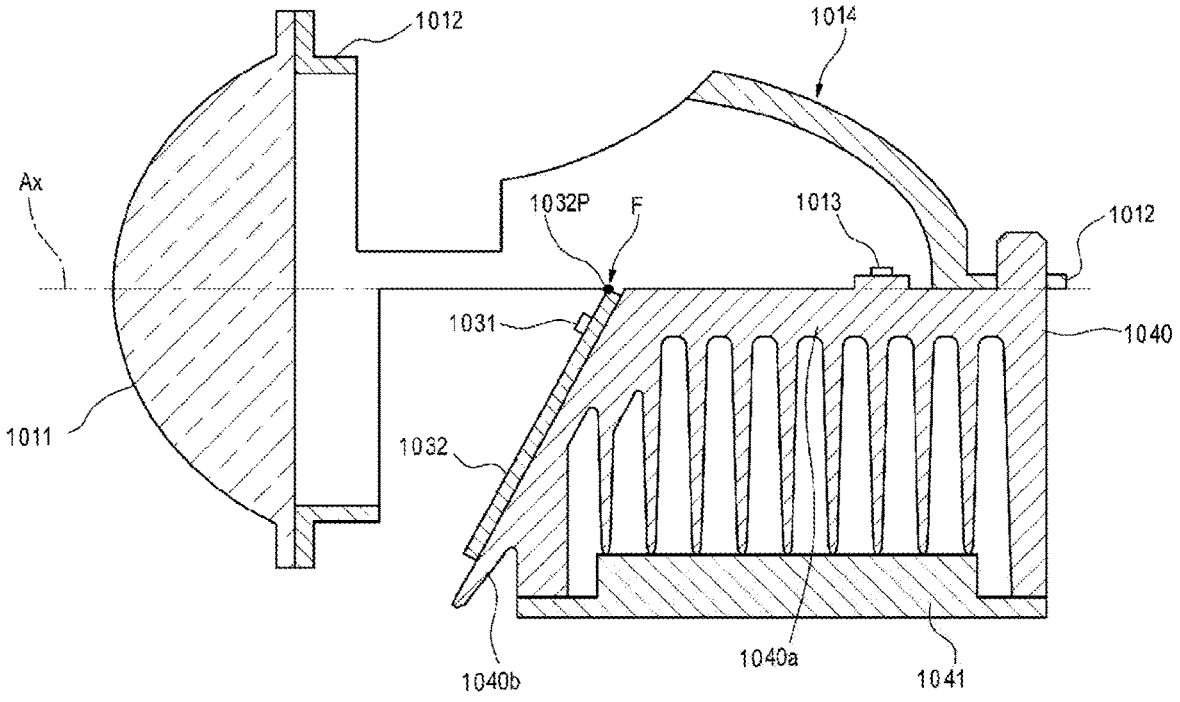
FIG. 19 is a view showing a modification of a shade member.

As shown in FIG. 19, in a state where the substrate 1032 is fixed to the inclined wall portion 1040*b* of the base member 1040, an upper tip end portion 1032*p* of the substrate 1032 can function as a shade for forming the cutoff lines CL1, CL2 of the low-beam light distribution pattern PL1. In this case, the substrate 1032 is fixed such that the tip end portion 1032*p* is positioned above the optical axis Ax. Further, the upper plate portion 1021 arranged in the above described manner is not disposed on the front side of the tip end portion 1032*p* of the substrate 1032. Meanwhile, although not shown in FIG. 19, a reflector for the light emitting elements 1031 may be provided above the substrate 1032, for example.

According to such a configuration, it becomes easy to arrange the light emitting elements 1031 in the vicinity of the rear focal point F of the projector lens 1011, and it is possible to improve the utilization efficiency of light emitted from the light emitting elements 1031. Further, since a part of the substrate 1032 on which the light emitting elements 1031 are mounted can be used as a shade, it is unnecessary to provide the upper plate portion 1021 which is provided as a shade in the above embodiment, and the number of parts can be reduced.

<Light Distribution Pattern>

Figure 20A:
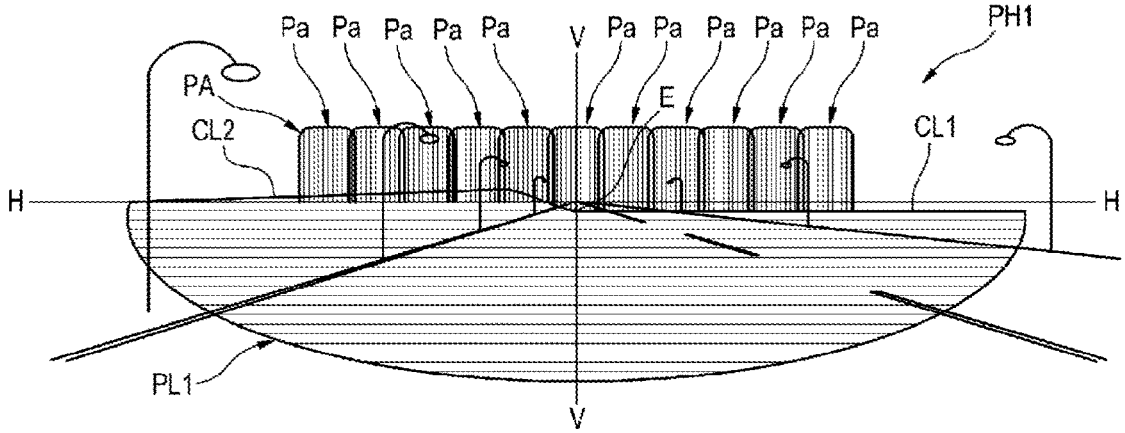
FIGS. 20A and 20B are views perspectively showing light distribution patterns which are formed on a virtual vertical screen disposed in front of the lamp by light irradiated from the vehicle lamps according to the first to fourth embodiments.
Figure 20B:
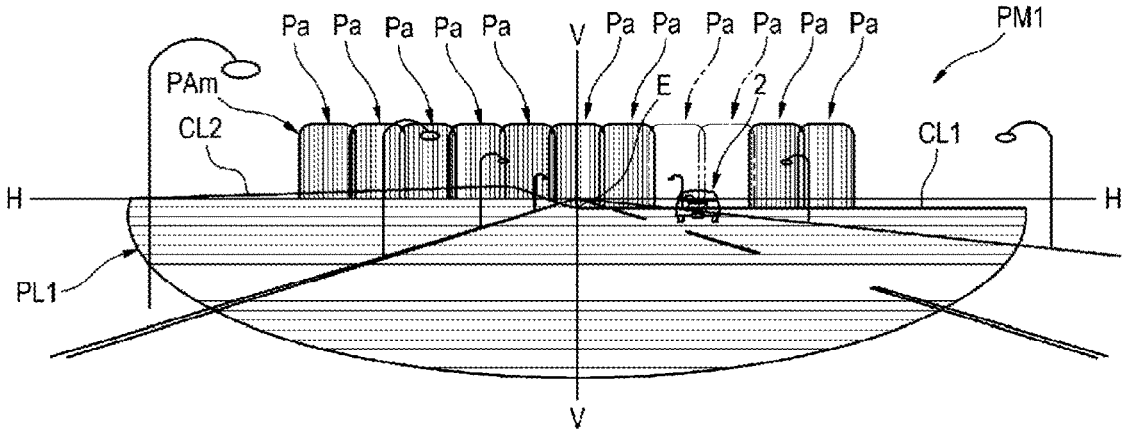

FIGS. 20A and 20B are views perspectively showing light distribution patterns which are formed on a virtual vertical screen disposed at a position of 25 m in front of the vehicle by light irradiated forward from the vehicle lamps 1A to ID and 1001 according to the first to fourth embodiments. FIG. 20A shows a high-beam light distribution pattern PH1, and FIG. 20B shows an intermediate light distribution pattern PM1. The high-beam light distribution pattern PH1 shown in FIG. 20A is formed as a combined light distribution pattern of the low-beam light distribution pattern PL1 and the additional high-beam light distribution pattern PA.

The low-beam light distribution pattern PL1 is a low-beam light distribution pattern of left light distribution and has the cutoff lines CL1, CL2 with different left and right levels at its upper end edge. The cutoff lines CL1, CL2 extend substantially horizontally with different left and right levels with a V-V line as a boundary. The V-V line vertically passes through a point H-V that is a vanishing point in the front direction of the lamp. An oncoming vehicle-lane side portion on the right side of the V-V line is formed as a lower stage cutoff line CL1, and an own vehicle-lane side portion on the left side of the V-V line is formed as an upper stage cutoff line CL2 which is stepped up from the lower stage cutoff line CL1 via an inclined portion.

The low-beam light distribution pattern PL1 is formed by projecting the light source images of the light emitting elements 13, 1013 formed on the rear focal planes of the projector lenses 11, 1011 by the light emitted from the light emitting elements 13, 1013 and reflected by the reflectors 14, 1014, as inverted projected images, on the virtual vertical screen by the projector lenses 11, 1011. The cutoff lines CL1, CL2 are formed as inverted projected images of the front end edges 21*a*1, 1021*a*1 in the upward reflective surfaces 21*a*, 1021*a* of the upper plate portions 21, 1021. That is, the front end edges 21*a*1, 1021*a*1 of the upward reflective surfaces 21*a*, 1021*a* function as shades for shielding a part of light emitted from the light emitting elements 13, 1013 and directed to the projector lenses 11, 1011 in order to form the cutoff lines CL1, CL2 of the low-beam light distribution pattern PL1.

In the low-beam light distribution pattern PL1, an elbow point E that is an intersection between the lower stage cutoff line CL1 and the V-V line is positioned at an angle of about 0.5° to 0.6° below the point H-V, for example.

In the high-beam light distribution pattern PH1, the additional light distribution pattern PA is additionally formed as a horizontally elongated light distribution pattern so as to spread upward from the cutoff lines CL1, CL2, thereby irradiating a travelling road in front of the vehicle in a wide range. The additional light distribution pattern PA is formed as a combined light distribution pattern of eleven light distribution patterns Pa. Each light distribution pattern Pa is a light distribution pattern which is formed as an inverted projected image of the light source image of each light emitting element formed on the rear focal plane of each of the projector lenses 11, 1011 by the light emitted from each of the light emitting elements 31, 1031.

Each light distribution pattern Pa has a substantially rectangular shape slightly long in the upper-lower direction. Although the light emission surface of each light emitting element has a square shape, each light distribution pattern Pa has a substantially rectangular shape slightly long in the upper-lower direction because the light reflected by the reflective surfaces 21*b*, 21*a* of the first to third embodiments and the reflected light by the reflective surfaces 1021*b*, 1021*a* of the fourth embodiment are diffused upward and downward. Further, the respective light distribution patterns Pa are formed so as to slightly overlap with each other between adjacent light distribution patterns Pa. The reason is that the light emitting elements are arranged behind the rear focal planes of the projector lenses 11, 1011 and the range of the bundle of light beams passing through the rear focal planes of the projector lenses 11, 1011 slightly overlaps between adjacent light emitting elements.

Furthermore, in the first embodiment, each light distribution pattern Pa is formed such that its lower end edge matches or partially overlaps with the cutoff lines CL1, CL2. The reason is that light (mainly from the light emitting elements 31) incident on the upper region 11A of the projector lens 11 is emitted as light (closer to the side of the low-beam light distribution pattern PL1) slightly downward from the upper exit surface 11*a* of the projector lens 11 by the curvature of the upper exit surface 11*a* being greatly curved.

Further, in the second to fourth embodiments, each light distribution pattern Pa is formed such that its lower end edge matches the cutoff lines CL1, CL2. The reason is that the downward reflective surfaces 21*b*, 1021*b* of the upper plate portions 21, 1021 for reflecting a part of light emitted from the light emitting elements 31, 1031 toward the front side are integrally formed with the upward reflective surfaces 21*a*, 1021*a* so that the downward reflective surfaces 21*b*, 1021*b* extend obliquely downward and rearward from the front end edges 21*a*1, 1021*a*1 of the upward reflective surfaces 21*a*, 1021*a* of the same upper plate portions 21, 1021 to a position near the upper side of the light emitting elements 31, 1031.

In the first to fourth embodiments, as compared with the high-beam light distribution pattern PH1, the intermediate light distribution pattern PM1 shown in FIG. 20B is formed as a light distribution pattern having an additional light distribution pattern PAm in which a part of the additional light distribution pattern PA is missing, instead of the additional light distribution pattern PA.

The additional light distribution pattern PAm is formed as a light distribution pattern in which the third and fourth light distribution patterns Pa from the right side of the eleven light distribution patterns Pa are missing, for example. The additional light distribution pattern PAm is formed by turning off the third and fourth light emitting element from the left side of the eleven light emitting elements 31, 1031. When such an intermediate light distribution pattern PM1 is formed, the illumination light from the vehicle lamps 1A to 1D and 1001 irradiates the travelling road in front of the vehicle as widely as possible within a range in which it does not give a glare to a driver of an on-coming vehicle 2 while being prevented from hitting the on-coming vehicle 2, for example. Further, as the position of the on-coming vehicle 2 changes, the shape of the additional light distribution pattern PAm is changed by sequentially switching the light emitting elements to be turned off. In this way, it is possible to maintain a state of widely irradiating the travelling road in front of the vehicle within a range in which it does not give a glare to a driver of the oncoming vehicle 2. Meanwhile, the presence of the oncoming vehicle 2 is detected by an in-vehicle camera or the like (not shown).

Meanwhile, in the case of the configuration capable of selectively performing a low-beam irradiation and a high-beam irradiation by a projector type optical system using a single projector lens, a member (shade) for shielding a part of light emitted from a light source is required in order to form the cutoff line of the low-beam light distribution pattern. Since a tip end of the shade is a part which cannot reflect light and causes a dark portion in the light distribution pattern, it is desired to form the tip end as thin as possible. However, it is impossible to physically reduce the thickness of the tip end to zero. Therefore, as shown in FIG. 5A, in the high-beam light distribution pattern PH1, a dark portion (hatched portion) 101 occurs between the low-beam light distribution pattern PL1 and the additional high-beam light distribution pattern PA by the size corresponding to the thickness of the shade.

On the contrary, according to the vehicle lamp 1A of the first embodiment, the optical path change portion 51 is formed in which the curvature of the exit surface in the upper exit surface 11*a* of the projector lens 11 disposed above the optical axis Ax is greatly curved. Therefore, the light (in which the ratio of light from the light emitting elements 31 is high) incident on the upper region 11A of the projector lens 11 is emitted slightly downward from the upper exit surface 11*a* by the optical path change portion 51, as compared with the case where the optical path change portion 51 is not provided. In this way, as shown in FIG. 5B, in the high-beam light distribution pattern PH1, the additional light distribution pattern PA can be slid downward (from the position indicated by the broken line to the position indicated by the solid line) as a whole, and the low-beam light distribution pattern PL1 and the additional light distribution pattern PA can partially overlap with each other at the portions of the cutoff lines CL1, CL2. Thus, it is possible to enhance the continuity between the low-beam light distribution pattern PL1 and the additional light distribution pattern PA. As a result, the occurrence of a dark portion appearing at a high-beam irradiation can be reduced, thereby reducing unnatural feeling to be caused to a driver.

Meanwhile, the same effect can be obtained even when the light is emitted slightly downward by the optical path change portion 51 and irradiated to allow the lower side of the additional light distribution pattern PA to spread downward (in the direction of the low-beam light distribution pattern PL1), and the low-beam light distribution pattern PL1 and the additional light distribution pattern PA overlap with each other.

Further, in the vehicle lamp 1A of the first embodiment, the light emitting elements 31 are arranged below the rear focal point F and can be individually turned on. Therefore, by selectively turning on some of the light emitting elements while avoiding an optical path of light of a first light source for forming a low-beam light distribution pattern, it is possible to form the additional light distribution pattern PAm in which a part of the additional light distribution pattern PA is missing. In this way, it is possible to form the intermediate light distribution pattern PM1 having a shape located between the low-beam light distribution pattern PL1 and the high-beam light distribution pattern PH1 with a plurality of types of irradiation patterns while enhancing the continuity between the low-beam light distribution pattern PL1 and the additional light distribution pattern PA.

Figure 21A:
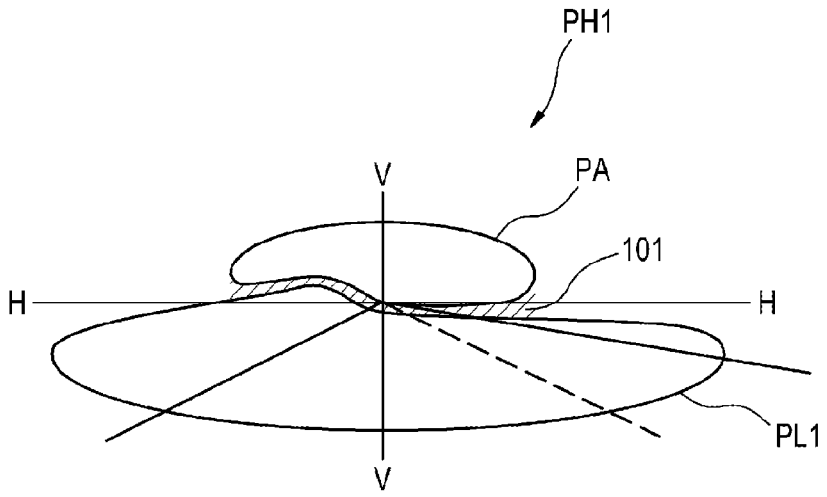
FIG. 21A shows an example of a light distribution pattern of a conventional vehicle lamp.

Further, in the case of the configuration capable of selectively performing a low-beam irradiation and a high-beam irradiation by a projector type optical system using a single projector lens, a member (shade) for shielding a part of light emitted from a low-beam light source is required in order to form the cutoff line of the low-beam light distribution pattern. Since a tip end of the shade is a part which cannot reflect light and causes a dark portion in the light distribution pattern, it is desired to form the tip end as thin as possible. However, in the configuration in which a shade is formed integrally with a tip end of a base member as in the related art, the tip end of the shade has a certain thickness due to the limitation in the processing conditions of the base member. Therefore, as shown in FIG. 21A, in the high-beam light distribution pattern PH1, the dark portion (hatched portion) 101 occurs between the low-beam light distribution pattern PL1 and the additional high-beam light distribution pattern PA by the size corresponding to the thickness of the shade.

Figure 21B:
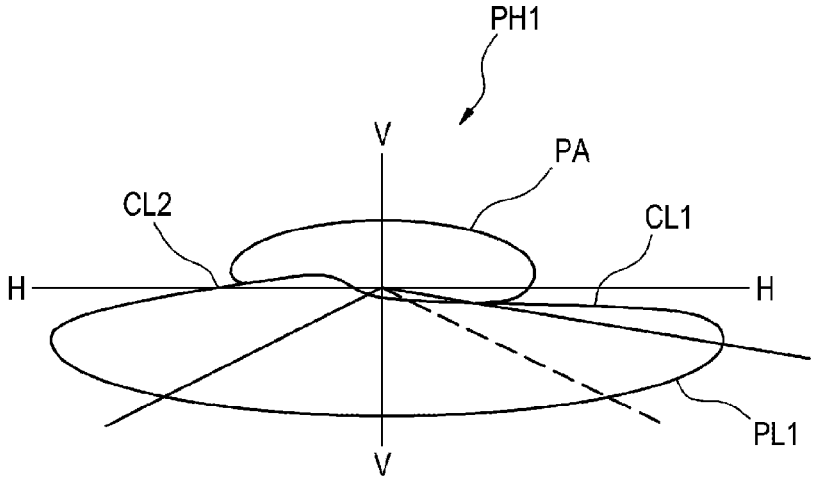
FIG. 21B shows an example of a light distribution pattern of the vehicle lamp of the second embodiment.

On the contrary, according to the vehicle lamps 1B, IC of the second embodiment, the optical member 20 serving as a shade is configured as a member separate from the base member 40. Therefore, the shape of the front end edge 21*a*1 of the upper plate portion 21 in the optical member 20 can be formed thinner without being limited by the processing conditions of the base member 40. In this way, the thickness of the front end edge 21*a*1, which has been an occurring cause of a dark portion in the high-beam light distribution pattern PH1, can be made smaller than a conventional one. As a result, as shown in FIG. 21B, it is possible to reduce the occurrence of a dark portion to an extent that is less noticeable as seen from a driver.

Figure 22:
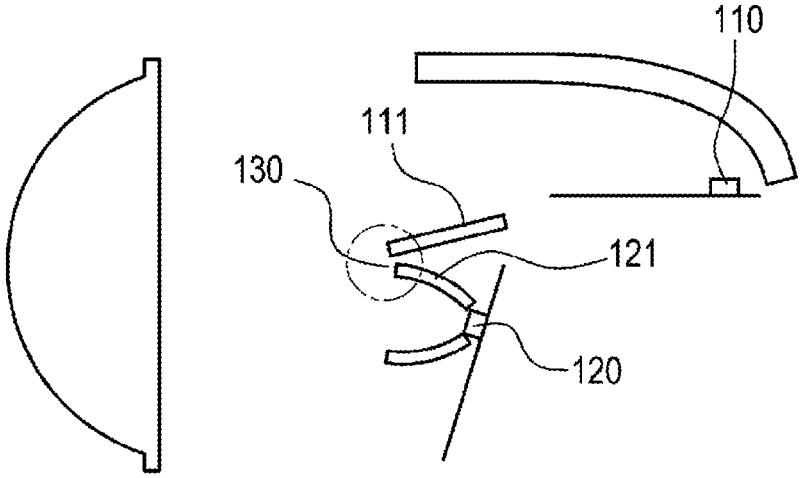
FIG. 22 is a view showing a configuration example of a conventional vehicle lamp.

Further, even when an optical member and a base member are made as separate parts, as shown in FIG. 22, in a configuration in which a shade 111 for shielding a part of light emitted from a low-beam light source 110 and a reflector 121 for reflecting a part of light emitted from a high-beam light emitting element 120 are formed as separate members, a gap 130 occurs between the shade 111 and the reflector 121. Therefore, similar to the light distribution pattern shown in FIG. 21A, the dark portion (hatched portion) 101 occurs between the low-beam light distribution pattern PL1 and the additional high-beam light distribution pattern PA by the size corresponding to the gap 130.

On the contrary, according to the vehicle lamps 1B, 1C of the second embodiment, the upward reflective surface 21*a* constituting the shade and the downward reflective surface 21*b* configured to reflect the light of the light emitting elements 31 are integrally formed as the upper surface and the lower surface of the upper plate portion 21. Therefore, a gap does not occur between the upward reflective surface 21*a* and the downward reflective surface 21*b*. Further, similar to the light distribution pattern shown in FIG. 21B, it is possible to enhance the continuity between the low-beam light distribution pattern PL1 and the additional light distribution pattern PA by reducing the occurrence of the dark portion to a non-noticeable extent.

Further, according to the vehicle lamps 1B, IC of the second embodiment, the upward reflective surface 21*a* of the upper plate portion 21 constituting the optical member 20 is configured as a reflective surface for reflecting light of the light emitting element 13, and the downward reflective surface 21*b* of the upper plate portion 21 and the reflective surface 22*a* of the lower plate portion 22 is configured as a reflective surface for reflecting light of the light emitting elements 31. Therefore, it is possible to efficiently reflect the light emitted from the light emitting element 13 and the light emitting elements 31 to the incident surface of the projector lens 11 by the optical member 20 configured as a single member.

Further, since the light emitting elements 31 are configured to be exposed from the opening 23 formed between the upper plate portion 21 and the lower plate portion 22, the substrate 32 on which the light emitting elements 31 are mounted can be easily arranged upward. Therefore, the light emitting elements 31 mounted on the substrate 32 can be arranged near the rear focal point F of the projector lens 11, and the utilization efficiency of direct light emitted from the light emitting elements 31 can be enhanced.

Further, when the reflective member 25 is fixed to the base member 40, a space S is formed above the front upper wall portion 40*a*1 of the base member 40. Therefore, the upper end portion 32*a* of the substrate 32 on which the light emitting elements 31 are mounted can be arranged above the optical axis Ax, and the upper end portion 32*a* arranged on the upper side can be accommodated in the space S. In this way, the degree of freedom in arranging the substrate 32 is improved and the light emitting elements 31 can be arranged near the rear focal point F of the projector lens 11, so that the utilization efficiency of direct light emitted from the light emitting elements 31 can be enhanced.

Further, the upward reflective surface 21*a* of the upper plate portion 21 and the upward reflective surface 25*a* of the reflective member 25 are arranged such that a stepped portion connecting the rear upper wall portion 40*a*2 of the base member 40 formed slightly higher than the horizontal plane including the optical axis Ax with the rear focal point F is configured by a smooth inclined surface. Therefore, it is possible to efficiently reflect the light emitted from the light emitting element 13 toward the projector lens 11 by the inclined surface.

Further, the substrate 32 on which the light emitting elements 31 are mounted is fixed, together with the optical member 20, to the base member 40 by the same fixing member 61. Therefore, the light emitting elements 31 can be easily arranged at positions close to the rear focal point F of the projector lens 11, and the utilization efficiency of direct light emitted from the light emitting elements 31 can be enhanced.

Further, aluminum die cast or transparent polycarbonate resin or the like having high heat resistance is used as the material of the optical member 20, and the optical member 20 is fixed to the base member 40 serving as a heat sink. In this way, the temperature rise of the optical member 20 is prevented, and it is possible to reduce the deformation and deterioration of the optical member 20 that can occur by sunlight passing through the projector lens 11 and condensed in the vicinity of the optical member 20.

Figure 23A:
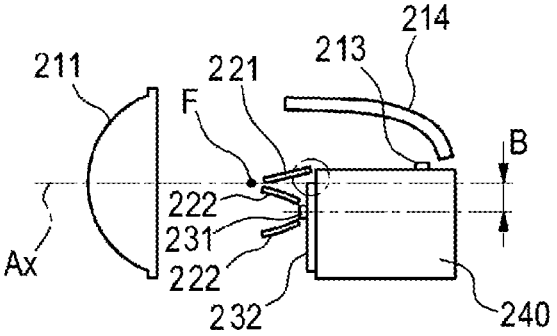
FIGS. 23A to 23E are views for comparing a light distribution pattern by a conventional configuration with a light distribution pattern according to a configuration of the third embodiment of the disclosure.

Furthermore, as a configuration example in which a low-beam irradiation and a high-beam irradiation can be selectively performed by a projector type optical system using a single projector lens, an example shown in FIG. 23A is considered. In this example, a light source 231 and a reflector 222 for forming the additional high-beam light distribution pattern PA are disposed below a shade 221 for forming the cutoff lines CL1, CL2 of the low-beam light distribution pattern PL. Normally, the light source 231 is mounted on a substrate 232 and fixed to a heat sink (base member) 240 in order to secure heat radiation. Furthermore, the light source 231 is mounted at a position securing a predetermined distance A from an end of the substrate 232 in order to secure heat radiation (see FIG. 23B).

Figure 23C:
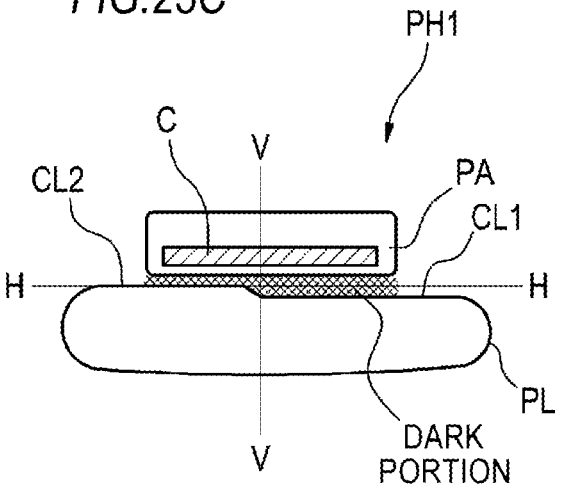
Figure 23B:
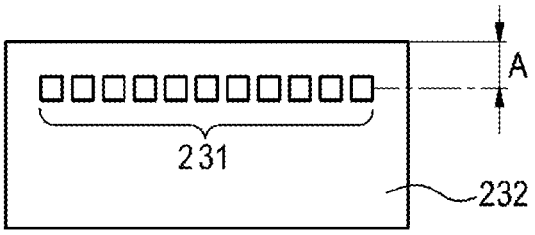

In this case, for example, as shown in FIG. 23A, the substrate 232 is fixed to a front surface of the heat sink 240 configured perpendicular to the optical axis Ax of a projector lens 211 so that a light emission surface of the light source 231 faces the projector lens 211. Therefore, the rate at which light (direct light) emitted in the front direction of the light source 231 passes through the vicinity of the rear focal point is not so high, and the utilization efficiency of light is lowered. Further, since the substrate 232 is fixed in a position (in a circle indicated by the broken line) where the upper portion of the substrate 231 does not interfere with the shade 221, the position of the light source 231 mounted on the substrate 232 is spaced downward by a large distance B from the optical axis Ax. Therefore, as shown in FIG. 23C, a portion C spaced upward from an H line in the additional high-beam light distribution pattern PH1 becomes brighter, and a good light distribution as the high-beam light distribution pattern PH1 cannot be obtained. Further, a dark portion may occur between the low-beam light distribution pattern PL and the additional high-beam light distribution pattern PA.

On the contrary, according to the vehicle lamp 1D of the third embodiment, the light emitting elements 31 mounted on the substrate 32 are arranged above the inclined wall portion 40*b* of the base member 40. In this case, the light emission surfaces 31*a* of the light emitting elements 31 are fixed at positions on the lower and rear side of the rear focal point F so as to face obliquely forward and upward. Therefore, most of light emitted from the light emitting elements 31 is allowed to pass through the vicinity of the rear focal point F while placing the positions of the light emitting elements 31 at positions avoiding a path of light for forming the low-beam light distribution pattern PL. In this way, the utilization efficiency of light of the light emitting elements 31 can be improved, and a good high-beam light distribution pattern PH1 can be obtained.

Figure 23D:
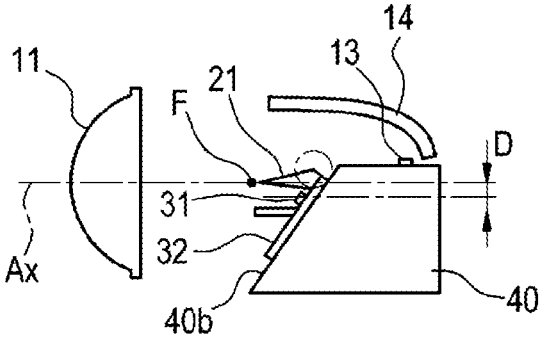
Figure 23E:
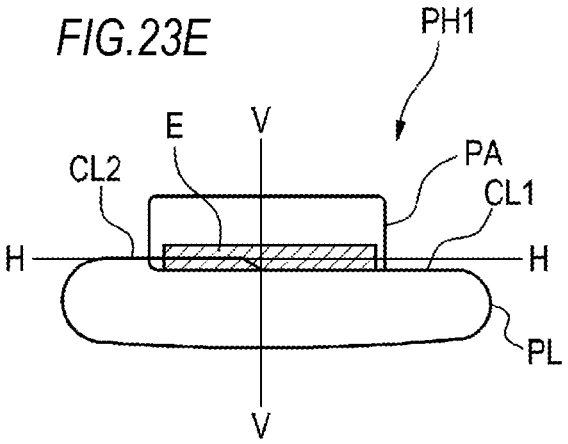

Further, as shown in FIG. 23D, a distance D from the light emitting elements 31 to the optical axis Ax can be made smaller than the distance B shown in FIG. 23A. Thus, since the light emitting elements 31 can be brought close to the rear focal point F, as shown in FIG. 23E, a portion E in the vicinity of the H line in the additional high-beam light distribution pattern PA can be brightened, and a good light distribution pattern as the high-beam light distribution pattern PH1 can be obtained. Further, a dark portion is unlikely to occur between the low-beam light distribution pattern PL and the additional high-beam light distribution pattern PA.

Further, the upper plate portion 21 of the optical member 20 serving as a shade is configured to also serve as a reflector (the downward reflective surface 21*b*) of the light emitting elements 31 and is fixed to the inclined wall portion 40*b* of the base member 40 together with the substrate 32. Therefore, since the substrate 32 and the upper plate portion 21 do not interfere with each other, the substrate 32 can be arranged upward. For example, the upper end portion 32*a* of the substrate 32 may be arranged above the optical axis Ax. In this way, the light emitting elements 31 mounted on the substrate 32 can be further brought close to the rear focal point F, and a good light distribution pattern as the high-beam light distribution pattern PH1 can be obtained.

Further, the light emitting elements 31 of the substrate 32 fixed to the inclined wall portion 40*b* of the base member 40 together with the optical member 20 are arranged to be exposed from the opening 23 formed in the optical member 20. Therefore, the light emitting elements 31 can be further easily arranged close to the rear focal point F, and a good light distribution pattern as the high-beam light distribution pattern PH1 can be obtained.

Further, the plurality of light emitting elements 31 are arranged in the left-right direction, and each of the light emitting elements 31 is fixed at a position on the lower and rear side of the rear focal point F so as to face obliquely forward and upward. Therefore, the utilization efficiency of light of the light emitting elements 31 can be improved, and a good light distribution pattern can be obtained.

Further, since the light emitting elements 31 are arranged so as to face obliquely forward and upward, the amount of light incident on the downward reflective surface 21*b* of the upper plate portion 21 from the light emitting elements 31 can be increased. Therefore, the light reflected by the downward reflective surface 21*b* is set to pass through the vicinity of the rear focal point F, and the portion near the H line can be further brightened, so that a good light distribution pattern as the high-beam light distribution pattern PH1 can be obtained.

Meanwhile, the disclosure is not limited to the above-described embodiments, but can be appropriately deformed or improved. In addition, the materials, shapes, dimensions, numerical values, modes, quantities, and locations and the like of the respective components in the above-described embodiments are arbitrary and not limited as long as they can achieve the disclosure.

The present application is based on Japanese Patent Application No. 2015-244410 filed on Dec. 15, 2015, Japanese Patent Application No. 2015-244411 filed on Dec. 15, 2015, Japanese Patent Application No. 2015-244412 filed on Dec. 15, 2015, and Japanese Patent Application No. 2015-244413 filed on Dec. 15, 2015, the contents of which are incorporated herein as a reference.

The invention claimed is:

1. A vehicle lamp configured to selectively perform a low-beam irradiation and a high-beam irradiation, the vehicle lamp comprising:

a projector lens;

a first light source disposed behind the projector lens and configured to emit light for forming a low-beam light distribution pattern;

a second light source disposed behind the projector lens and configured to emit light for forming an additional high-beam light distribution pattern;

a shade disposed behind the projector lens and configured to form a cutoff line of the low-beam light distribution pattern; and an optical path change portion configured to change an optical path of only a part of light emitted from the second light source so as to travel toward a portion between the low-beam light distribution pattern and the additional high-beam light distribution pattern;

wherein the optical path change portion is formed in a region of an incident surface of the projector lens where an incident rate of light emitted from the second light source is higher than that of light emitted from the first light source;

wherein the optical path change portion is formed as a lens step on the region of the incident surface.

2. A vehicle lamp configured to selectively perform a low-beam irradiation and a high-beam irradiation, the vehicle lamp comprising:

a projector lens;

a first light source disposed behind the projector lens and configured to emit light for forming a low-beam light distribution pattern;

a second light source disposed behind the projector lens and configured to emit light for forming an additional high-beam light distribution pattern;

a shade disposed behind the projector lens and configured to form a cutoff line of the low-beam light distribution pattern; and an optical path change portion configured to change an optical path of a part of light emitted from the second light source so as to travel toward a portion between the low-beam light distribution pattern and the additional high-beam light distribution pattern;

wherein the optical path change portion is formed in a region of an exit surface of the projector lens where an emission rate of light emitted from the second light source is higher than that of light emitted from the first light source.

3. A vehicle lamp configured to selectively perform a low-beam irradiation and a high-beam irradiation, the vehicle lamp comprising:

a projector lens;

a first light source disposed behind the projector lens and configured to emit light for forming a low-beam light distribution pattern;

a second light source disposed behind the projector lens and configured to emit light for forming an additional high-beam light distribution pattern;

a base member on which the first light source and the second light source are disposed; and an optical member being a member separate from the base member and configured to serve as a shade for forming a cutoff line of the low-beam light distribution pattern in a state of being attached to the base member;

wherein an opening portion is formed in the optical member, and wherein in a state where the optical member is attached to the base member, the second light source is exposed from the opening portion toward a front of the lamp.

4. The vehicle lamp according to claim 3, wherein the optical member is formed with an upper plate portion above the opening portion, and wherein an upper surface of the upper plate portion includes a first reflective surface configured to reflect light emitted from the first light source toward the projector lens.

5. The vehicle lamp according to claim 4, wherein a lower surface of the upper plate portion on a side opposite to the upper surface includes a second reflective surface configured to reflect light emitted from the second light source toward the projector lens.

6. The vehicle lamp according to claim 4, wherein a tip end of the upper plate portion in a front-rear direction of the lamp is configured to form a cutoff line of the low-beam light distribution pattern.

7. The vehicle lamp according to claim 4, wherein the optical member is formed with a lower plate portion below the opening in the optical member, and wherein an upper surface of the lower plate portion includes a third reflective surface configured to reflect light emitted from the second light source toward the projector lens.

8. The vehicle lamp according to claim 3, wherein the second light source includes a light emitting element and a substrate on which the light emitting element is disposed, wherein an upper end portion of the substrate is arranged above an optical axis of the projector lens, and wherein the vehicle lamp includes a cover member covering the upper end portion from above and configured to reflect light emitted from the first light source toward the projector lens.

9. The vehicle lamp according to claim 3, wherein the second light source includes a light emitting element and a substrate on which the light emitting element is disposed, wherein the base member includes a first surface on which the first light source is disposed and a second surface to which the substrate of the second light source is fixed, and wherein in a state where the optical member is attached to the base member, a gap in which an upper end portion of the substrate enters is formed between the optical member and a tip end of the first surface in the front-rear direction of the lamp.

10. The vehicle lamp according to claim 8, wherein the substrate is interposed between the base member and the optical member and is fixed, together with the optical member, to the base member by a fixing member.

11. The vehicle lamp according to claim 3, wherein in a state where the optical member is attached to the base member, the optical member serves as the shade for forming the cutoff line of the low-beam light distribution pattern and also serve as a reflector for reflecting at least a part of light emitted from the second light source toward the projector lens.

* * * * *